US011649793B1

(12) United States Patent
Thomas

(10) Patent No.: US 11,649,793 B1
(45) Date of Patent: May 16, 2023

(54) INTAKE MANIFOLD ASSEMBLY FOR INTERNAL COMBUSTION ENGINE SYSTEM

(71) Applicant: CUMMINS INC., Columbus, IN (US)

(72) Inventor: Taylor Blaze Thomas, Indianapolis, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/517,172

(22) Filed: Nov. 2, 2021

(51) Int. Cl.
*F02M 35/10* (2006.01)
*F02M 35/104* (2006.01)

(52) U.S. Cl.
CPC .... *F02M 35/104* (2013.01); *F02M 35/10085* (2013.01); *F02M 35/10118* (2013.01); *F02M 35/10222* (2013.01); *F02M 35/10295* (2013.01)

(58) Field of Classification Search
CPC ..... F02M 35/104; F02M 35/10085; F02M 35/10118; F02M 35/10222; F02M 35/10295; F02M 25/0771
See application file for complete search history.

(56) References Cited

U.S. PATENT DOCUMENTS 4,938,176 A 7/1990 Tanaka et al.
6,073,617 A 6/2000 Busato et al.
6,244,255 B1 6/2001 Sagata et al.
6,327,854 B1 * 12/2001 Bonny ..... F01N 13/1805 60/322
9,995,257 B2 6/2018 Mammarella
2002/0023630 A1 2/2002 Balekai et al.
2013/0298882 A1 * 11/2013 Stabnik ..... F02M 26/47 73/861.63
2015/0059713 A1 * 3/2015 Forshier ..... F02M 35/10222 123/568.11

OTHER PUBLICATIONS

Engine—Breather System; Burton Power: https://www.burtonpower.com/tuning-guides/tuning-guide-pages/engine-breather-system.html. Last accessed Aug. 16, 2021.

(Continued)

*Primary Examiner* — Syed O Hasan
(74) *Attorney, Agent, or Firm* — Foley & Lardner LLP

(57) ABSTRACT

An intake manifold assembly includes an exhaust gas recirculation system and an intake manifold. The exhaust gas recirculation system includes a venturi with a venturi body. The venturi body includes an upstream cylindrical portion, a convergent portion, a downstream cylindrical portion, and a divergent portion. The upstream cylindrical portion is in exhaust gas receiving communication with a cylinder of an internal combustion engine system and configured to receive the exhaust gas from the cylinder. The convergent portion is contiguous with the upstream cylindrical portion and in exhaust gas receiving communication with the upstream cylindrical portion. The downstream cylindrical portion is contiguous with the convergent portion, separated from the upstream cylindrical portion by the convergent portion, and in exhaust gas receiving communication with the convergent portion. The divergent portion is contiguous with the downstream cylindrical portion and separated from the convergent portion by the downstream cylindrical portion.

15 Claims, 42 Drawing Sheets

(56) References Cited

OTHER PUBLICATIONS

Exhaust Gas Recirculation System—an overview; ScienceDirect: https://www.sciencedirect.com/topics/engineering/exhaust-gas-recirculation-system. Last accessed Aug. 16, 2021.
Exhaust Gas Recirculation (EGR) Complete Guide—Introduction; X-Engineer: https://x-engineer.org/automotive-engineering/internal-combustion-engines/ice-components-systems/exhaust-gas-recirculation-egr-complete-guide-introduction/. Last accessed Aug. 16, 2021.
Measurement of Fluid Flow by Means of Pressure Differential Devices Inserted in Circular Cross-Section Conduits Running Full—Part 1: General Principles and Requirements; Online Browsing Platform ISO 5167-1:2003(en): https://www.iso.org/obp/ui/#iso:std:iso:5167:-1:ed-2:v1:en. Last accessed Aug. 17, 2021.
What is Exhaust Gas Recirculation (EGR) & How It Works?; CarBikeTech, Apr. 5, 2019: https://carbiketech.com/exhaust-gas-recirculation-egr-design-function/. Last accessed Aug. 16, 2021.

* cited by examiner

INTAKE MANIFOLD ASSEMBLY FOR INTERNAL COMBUSTION ENGINE SYSTEM

TECHNICAL FIELD

The present application relates generally to intake manifold assemblies for internal combustion engine systems.

BACKGROUND

Internal combustion engines combust a fuel to produce energy. An internal combustion engine may include an exhaust gas recirculation (EGR) system. The EGR system provides exhaust gas back to an intake manifold of the internal combustion engine. The intake manifold combines intake air with the exhaust gas from the EGR system and provides the combined air and exhaust gas to the internal combustion engine. As a result, the internal combustion engine combusts fuel in combination with air and the exhaust gas.

SUMMARY

In one set of embodiments, an intake manifold assembly includes an exhaust gas recirculation system and an intake manifold. The exhaust gas recirculation system includes a venturi with a venturi body. The venturi body includes an upstream cylindrical portion, a convergent portion, a downstream cylindrical portion, and a divergent portion. The upstream cylindrical portion is in exhaust gas receiving communication with a cylinder of an internal combustion engine system and configured to receive the exhaust gas from the cylinder. The convergent portion is contiguous with the upstream cylindrical portion and in exhaust gas receiving communication with the upstream cylindrical portion. The downstream cylindrical portion is contiguous with the convergent portion, separated from the upstream cylindrical portion by the convergent portion, and in exhaust gas receiving communication with the convergent portion. The divergent portion is contiguous with the downstream cylindrical portion, separated from the convergent portion by the downstream cylindrical portion, and in exhaust gas receiving communication with the downstream cylindrical portion. The intake manifold includes an intake manifold body. The intake manifold body includes an air inlet body, an exhaust gas inlet body, and an outlet body. The air inlet body is configured to receive air. The exhaust gas inlet body is in exhaust gas receiving communication with the divergent portion. The outlet body is in air receiving communication with the air inlet body and exhaust gas receiving communication with the exhaust gas inlet body.

In another set of embodiments, an internal combustion engine system includes a cylinder head, an exhaust manifold, and an intake manifold assembly. The cylinder head has a hot side and a cold side. The exhaust manifold is in exhaust gas receiving communication with the cylinder head. The exhaust manifold is coupled to the hot side. The intake manifold assembly includes an intake manifold and an exhaust gas recirculation system. The intake manifold has an intake manifold body that is configured to receive air, in exhaust gas receiving communication with the exhaust manifold, and configured to provide a mixture of the air and the exhaust gas to the cylinder head. The intake manifold body is coupled to the cold side. The exhaust gas recirculation system includes an exhaust gas recirculation valve and a venturi. The exhaust gas recirculation valve is in exhaust gas receiving communication with the exhaust manifold. The venturi has a venturi body in exhaust gas receiving communication with the exhaust gas from the exhaust gas recirculation valve and to provide the exhaust gas to the intake manifold, the venturi body coupled to the intake manifold.

In yet another set of embodiments, an internal combustion engine system includes a cylinder head, an exhaust manifold, and an intake manifold assembly. The cylinder head has a hot side and a cold side. The exhaust manifold is configured to receive exhaust gas from the cylinder head. The exhaust manifold is coupled to the hot side. The intake manifold assembly includes an intake manifold, an upstream isolator, and an exhaust gas recirculation system. The intake manifold is configured to receive air, receive the exhaust gas, and provide a mixture of the air and the exhaust gas to the cylinder head. The intake manifold is coupled to the cold side. The intake manifold includes an upstream venturi flange having an upstream venturi flange aperture. The exhaust gas recirculation system includes a venturi with a venturi body configured to receive the exhaust gas from the exhaust manifold and to provide the exhaust gas to the intake manifold. The venturi body includes an upstream intake flange having an upstream intake flange aperture. The upstream isolator is inserted within the upstream intake flange aperture.

BRIEF DESCRIPTION OF THE DRAWINGS

The details of one or more implementations are set forth in the accompanying drawing and the description below. Other features, aspects, and advantages of the disclosure will become apparent from the description, the drawing, and the claims, in which:

FIG. 32 is a perspective view of a portion of the intake manifold assembly shown in FIG. 27;

Figure 1:
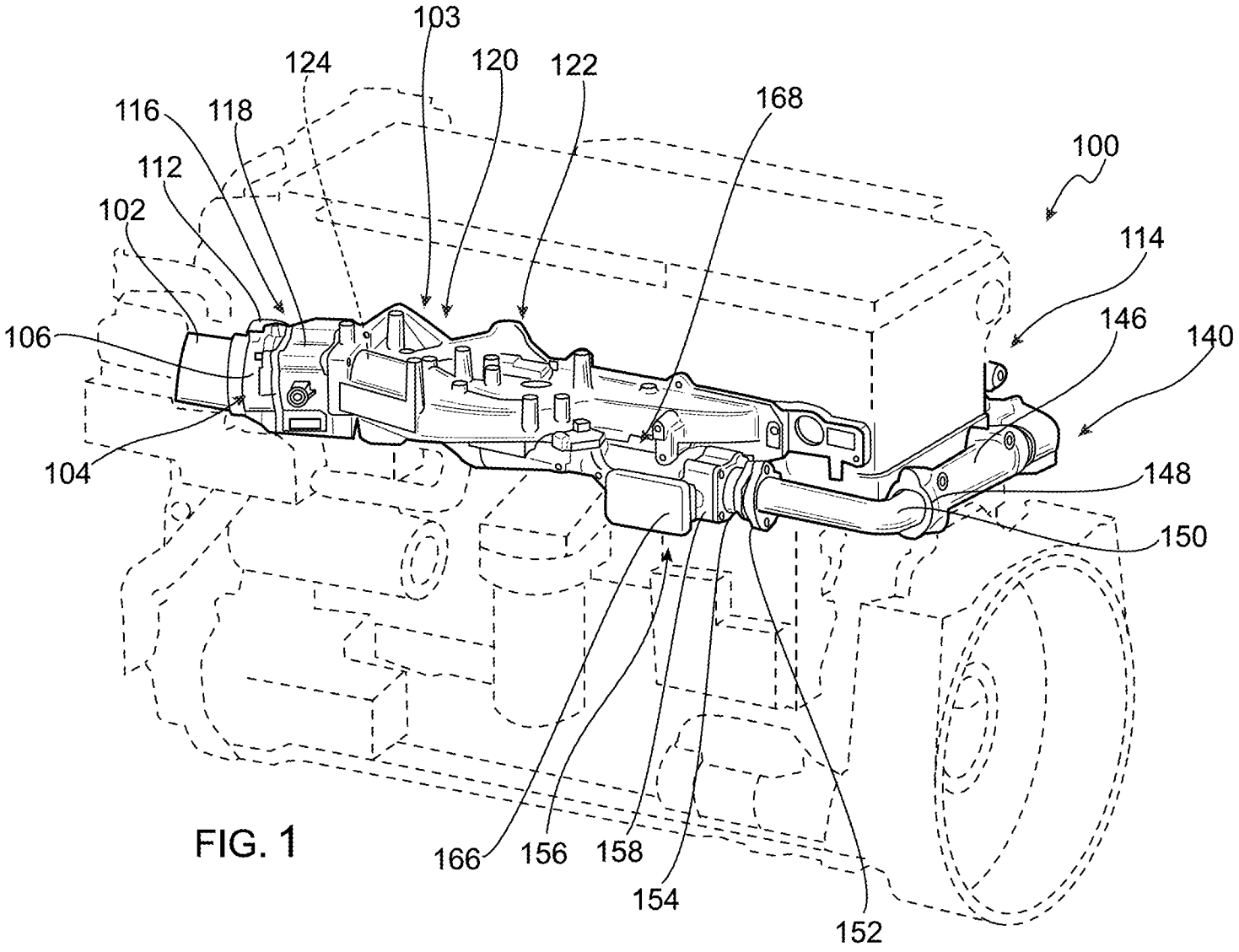
FIG. 1 is a perspective view of an example internal combustion engine system including an intake manifold assembly.

It will be recognized that the Figures are schematic representations for purposes of illustration. The Figures are provided for the purpose of illustrating one or more implementations with the explicit understanding that the Figures will not be used to limit the scope or the meaning of the claims.

DETAILED DESCRIPTION

Following below are more detailed descriptions of various concepts related to, and implementations of, methods, apparatuses, and systems for providing air and exhaust gas to a cylinder head of an internal combustion engine. The various concepts introduced above and discussed in greater detail below may be implemented in any of a number of ways, as the described concepts are not limited to any particular manner of implementation. Examples of specific implementations and applications are provided primarily for illustrative purposes.

I. Overview

An internal combustion engine may include an EGR system. The EGR system provides exhaust gas back to an intake manifold of the internal combustion engine. The intake manifold combines intake air with the exhaust gas from the EGR system and provides the combined air and exhaust gas to the internal combustion engine. As a result, the internal combustion engine combusts fuel in combination with air and the exhaust gas.

The exhaust gas functions to reduce a relative amount of air in the combined air and exhaust gas provided to the internal combustion engine (e.g., compared to an internal combustion engine without an EGR system). The exhaust gas also functions to reduce a temperature of combustion (e.g., due to decreased air in the combined air and exhaust gas, etc.) within the internal combustion engine (e.g., compared to an internal combustion engine without an EGR system). In these ways, the production of undesirable byproducts (e.g., nitrogen oxides ($NO_x$), etc.) by the internal combustion engine may be reduced.

EGR systems can be relatively large and can undesirably protrude from a footprint of an internal combustion engine. As a result, it may be difficult or impossible to incorporate an EGR system in some applications, such as those with particularly stringent packaging requirements.

Implementations herein are directed to an internal combustion engine system that includes an intake manifold assembly which has a venturi coupled to an intake manifold body that is coupled to a cold side (e.g., intake side, etc.) of a cylinder head. The venturi receives exhaust gas from the cylinder head and provides the exhaust gas to the intake manifold body. The intake manifold body receives air and the exhaust gas, mixes the air and the exhaust gas, and provides the mixture of the air and the exhaust gas to the cylinder head. By coupling the venturi to the intake manifold body in this fashion, an overall footprint of the intake manifold assembly may be desirably reduced, which may enable the intake manifold assembly to be utilized in applications where differently sized systems, such as those where a concentrator is coupled to a hot side of a cylinder head, cannot be used.

II. Example Internal Combustion Engine System with Intake Manifold Assembly

FIG. 1 depicts an example internal combustion engine system 100. The internal combustion engine system may be, for example, a diesel internal combustion engine system, a gasoline internal combustion engine system, a hybrid internal combustion engine system, a propane internal combustion engine system, a dual-fuel internal combustion engine system, a natural gas internal combustion engine system, etc. The internal combustion engine system 100 is configured to combust a fuel (e.g., diesel fuel, gasoline, propane, natural gas, etc.) to produce energy that may be utilized by various outputs. For example, the internal combustion engine system 100 may produce energy that is utilized to drive a movement member (e.g., wheel, tread, propeller, impeller, turbine, rotor, etc.) or power a generator.

The internal combustion engine system 100 includes an inlet conduit 102 (e.g., air conduit, etc.). The inlet conduit 102 receives air (e.g., ambient air, etc.) from an air source (e.g., air intake, air box, air filter, charge air cooler, etc.). As is explained in more detail herein, the air received by the inlet conduit 102 is compositionally distinct from exhaust gas produced by the internal combustion engine system 100. The inlet conduit 102 does not receive exhaust gas.

The internal combustion engine system 100 also includes an intake manifold assembly 103. As is explained in more detail herein, the intake manifold assembly 103 is configured to separately receive air and exhaust gas, mix the air and the exhaust gas, and provide the mixture of air and exhaust gas to cylinders of the internal combustion engine system 100.

Figure 2:
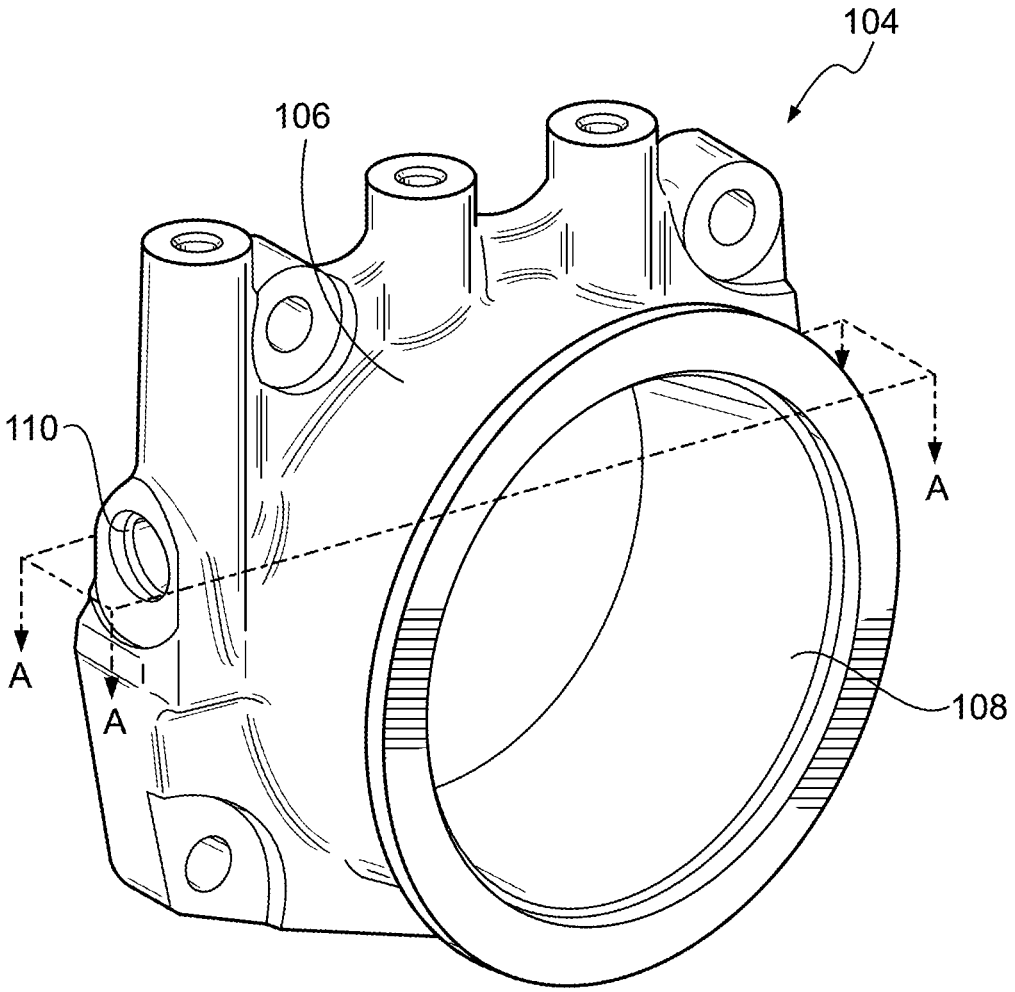
FIG. 2 is a perspective view of an inlet adaptor of the intake manifold assembly of FIG. 1.
Figure 3:
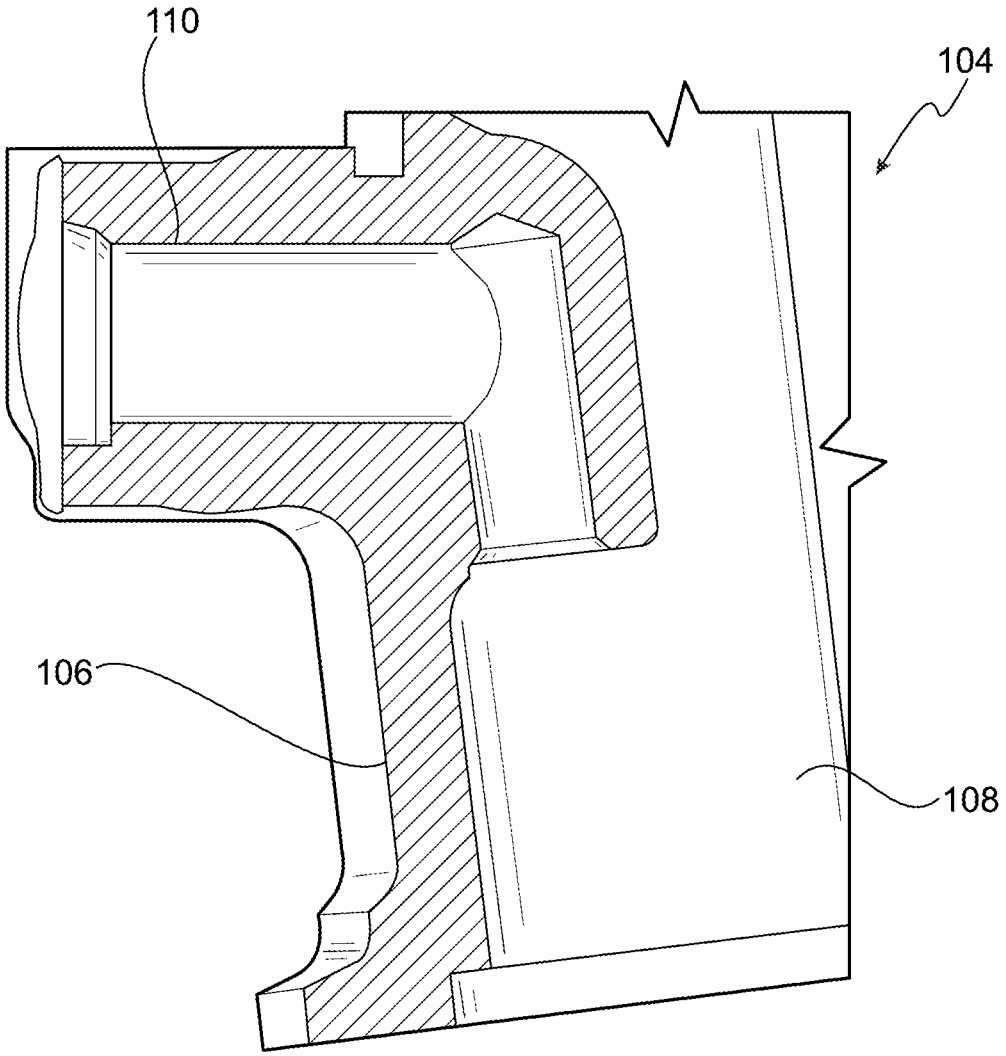
FIG. 3 is a cross-sectional view of a portion of the inlet adaptor shown in FIG. 2 taken along plane A-A.

The intake manifold assembly 103 includes an inlet adaptor 104 (e.g., connector, etc.). As shown in FIGS. 2 and 3, the inlet adaptor 104 includes an adaptor body 106 (e.g., frame, etc.). The inlet adaptor 104 also includes an adaptor opening 108 (e.g., bore, etc.) extending through the adaptor body 106. The adaptor opening 108 is configured to receive the air from the inlet conduit 102 and provide the air through the inlet conduit 102. In various embodiments, the inlet conduit 102 is inserted within the adaptor opening 108, and the inlet conduit 102 is secured to the adaptor body 106. The inlet adaptor 104 also includes a breather aperture 110 (e.g., hole, opening, etc.). The breather aperture 110 extends through the adaptor body 106 and is contiguous with the adaptor opening 108. As shown in FIG. 3, an inlet portion of the breather aperture 110 is oriented towards the inlet conduit 102. As a result, some of the air flowing through the adaptor opening 108 flows into the breather aperture 110.

Figure 4:
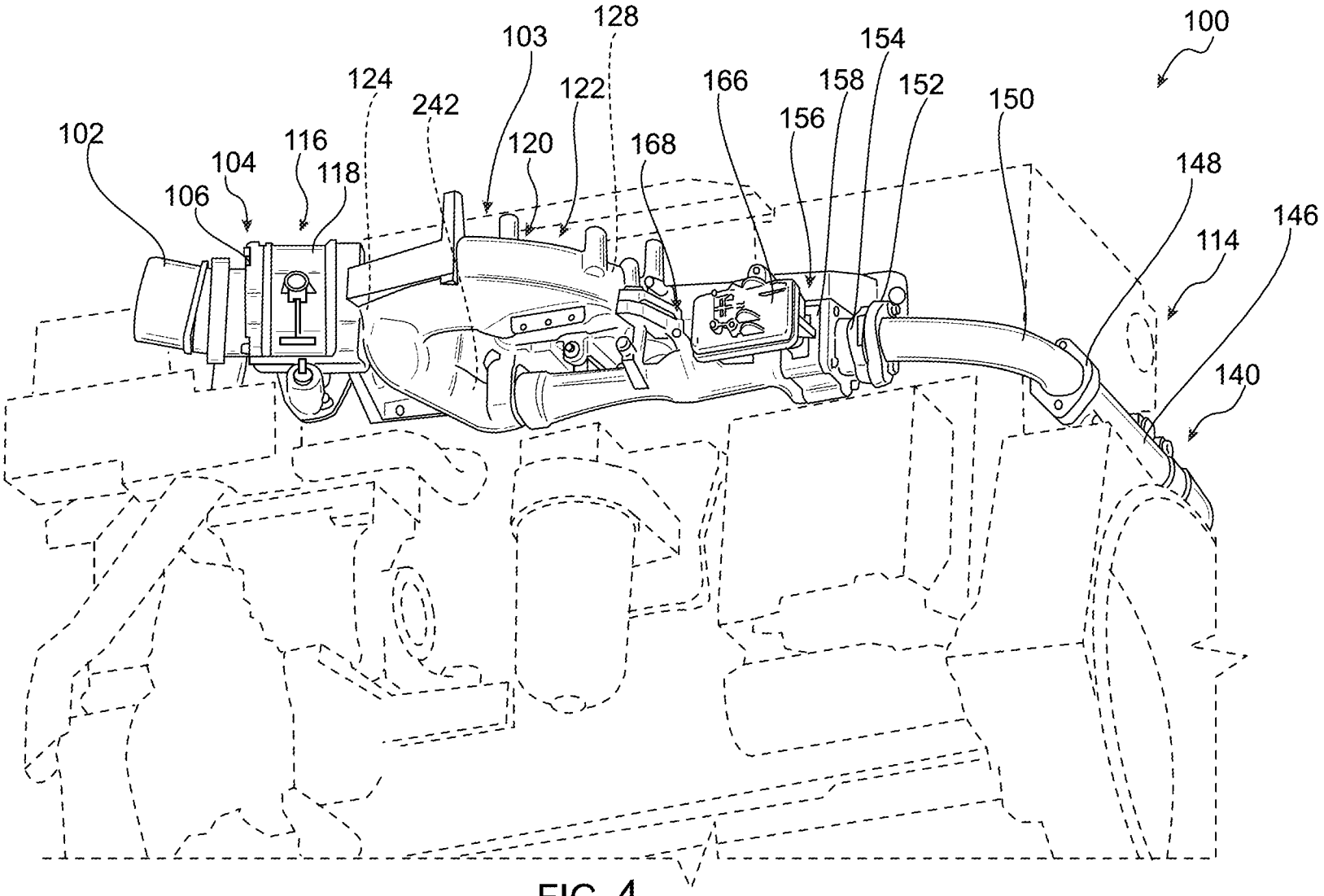
FIG. 4 is another perspective view of the internal combustion engine system shown in FIG. 1.

Referring again to FIG. 1, the internal combustion engine system 100 also includes a breather conduit 112. The breather conduit 112 is coupled to the adaptor body 106 around the adaptor opening 108 and is configured to receive the air from the breather aperture 110. As shown in FIGS. 1 and 4, the internal combustion engine system 100 also includes a cylinder head 114. As is explained in more detail herein, the cylinder head 114 facilitates combustion of the fuel and includes a breather system (e.g., jet pump system, vacuum system, etc.) that uses the air from the inlet adaptor 104 to maintain fluid (e.g., oil, etc.) at various locations within the internal combustion engine system 100. The cylinder head 114 includes a breather inlet and the breather conduit 112 is coupled to the cylinder head 114 around the breather inlet. As a result, the breather system of the cylinder head 114 is configured to receive the air from the breather aperture 110.

The intake manifold assembly 103 also includes an air throttle 116 (e.g., valve, throttle valve, electronic valve, intake throttle, valve assembly, etc.). The air throttle 116 includes an air throttle body 118 (e.g., frame, etc.). The air throttle body 118 is coupled to the inlet adaptor 104. The air throttle 116 also includes an air throttle opening (e.g., bore, etc.) extending through the air throttle body 118. The air throttle opening is configured to receive the air from the adaptor opening 108 and provide the air through the air throttle body 118.

The air throttle 116 also includes an air throttle plate (e.g., valve member, etc.). The air throttle plate is disposed within the air throttle opening and is rotatable within the air throttle opening to control flow of the air through the air throttle opening. The air throttle 116 also includes an air throttle shaft. The air throttle shaft extends through at least a portion of the air throttle body 118 and is coupled to the air throttle plate such that the rotation of the air throttle shaft causes rotation of the air throttle plate within the air throttle opening.

The air throttle 116 also includes an air throttle actuator 117 (e.g., solenoid, linear actuator, rotary actuator, etc.). The air throttle actuator 117 is configured to cause rotation of the air throttle shaft and therefore rotation of the air throttle plate. The air throttle actuator 117 is operable between a first position, where the air throttle plate inhibits flow of the air through the air throttle body 118 (e.g., less than 1% of the air that is received by the air throttle opening flows between the air throttle plate and the air throttle body 118, etc.), and a second position, where the air throttle plate does not inhibit flow of the air through the air throttle body 118.

The intake manifold assembly 103 includes an intake manifold 120 (e.g., mixing manifold, etc.). The intake manifold 120 includes an intake manifold body 122 (e.g., frame, etc.). The intake manifold body 122 is coupled to a first side (e.g., cold side, intake side, etc.) of the cylinder head 114. In various embodiments, the intake manifold body 122 is cast from a metal, such as aluminum. At least a portion of the intake manifold 120 may be coated with an anti-corrosive coating.

The intake manifold body 122 includes an air inlet body 124 (e.g., portion, etc.). The air inlet body 124 is coupled to the air throttle body 118. The air inlet body 124 is configured to facilitate provision of the air from the air throttle 116 into the intake manifold 120. The intake manifold body 122 also includes an air inlet 126 that extends through the air inlet body 124. The air inlet 126 receives the air from the air throttle 116.

Figure 7:
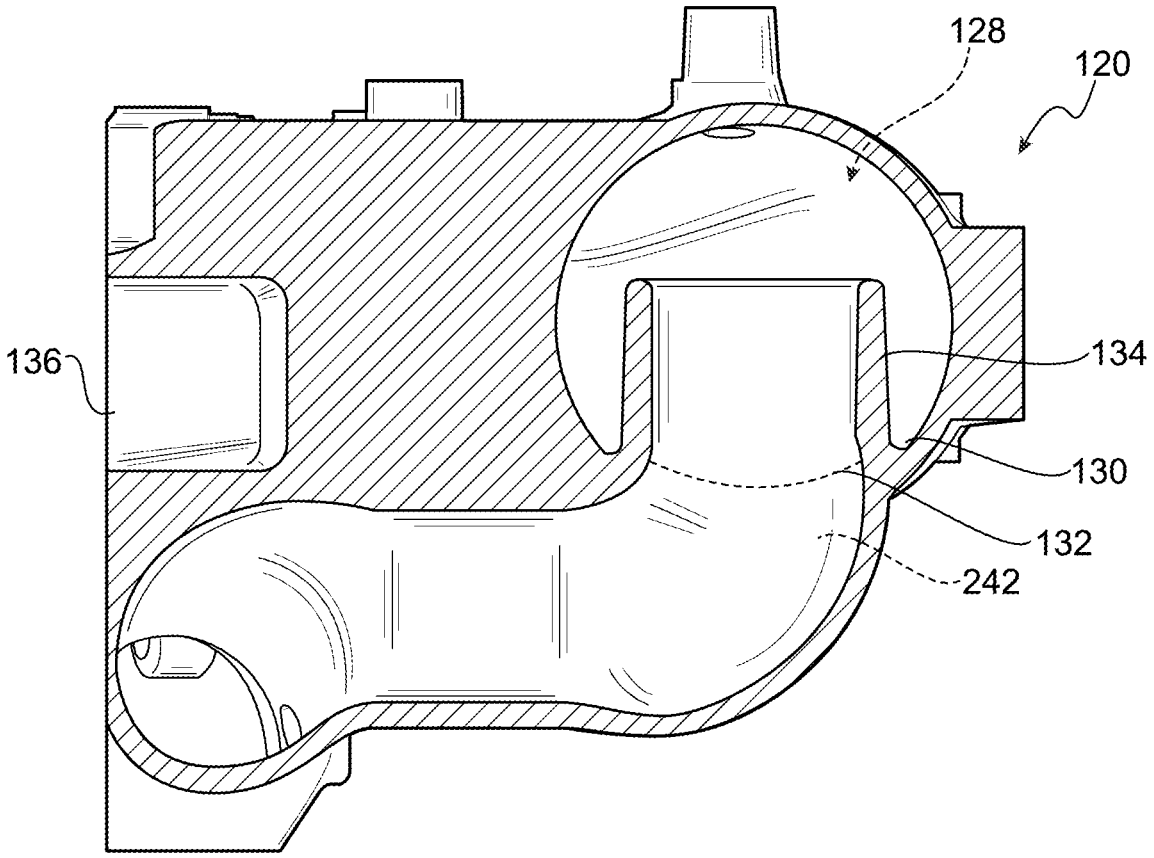
FIG. 7 is a cross-sectional view of the intake manifold shown in FIG. 6 taken along plane B-B.
Figure 8:
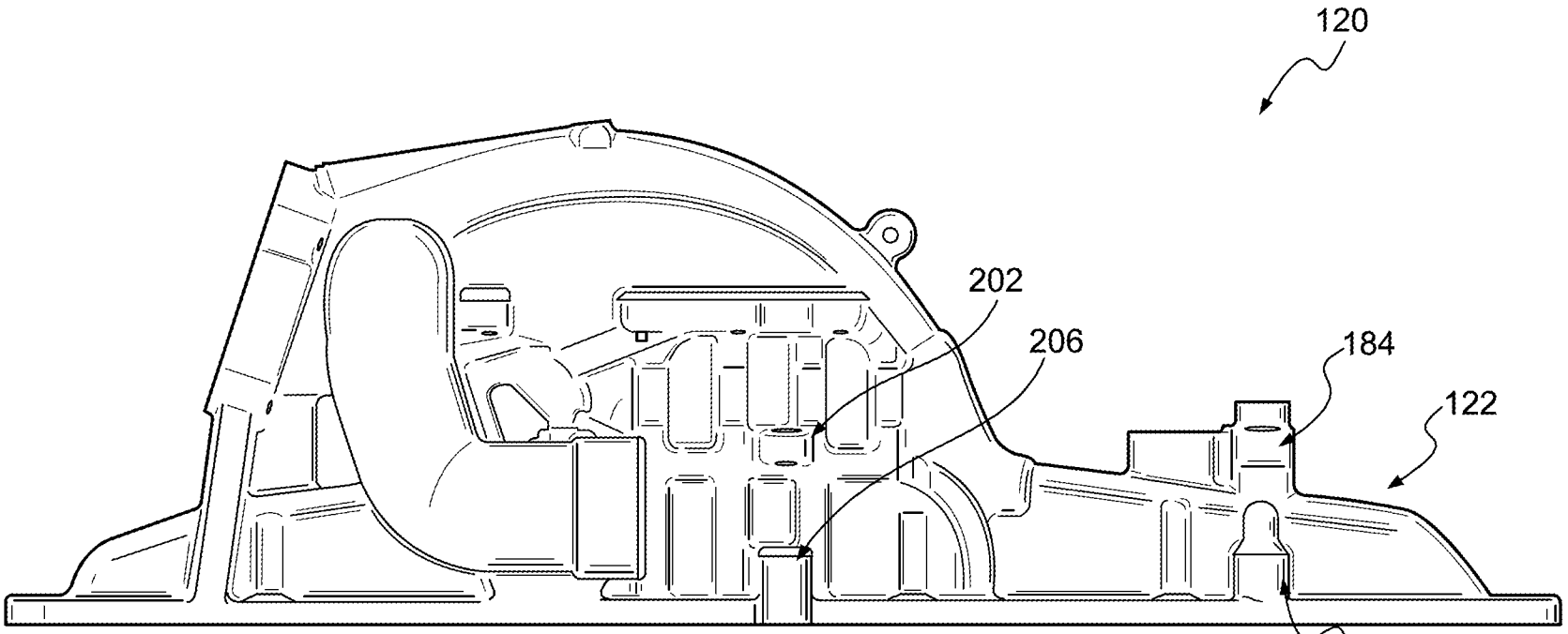
FIG. 8 is a bottom view of the intake manifold shown in FIG. 6.
Figure 9:
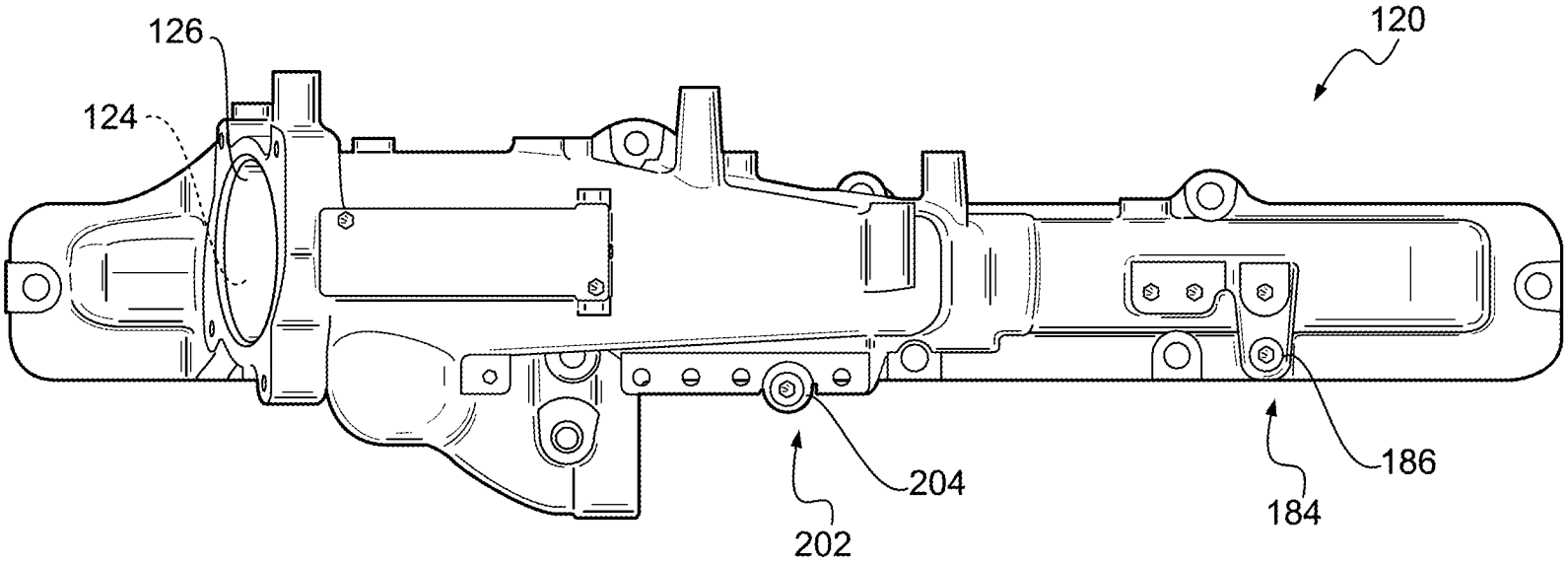
FIG. 9 is a front view of the intake manifold shown in FIG. 6.
Figure 10:
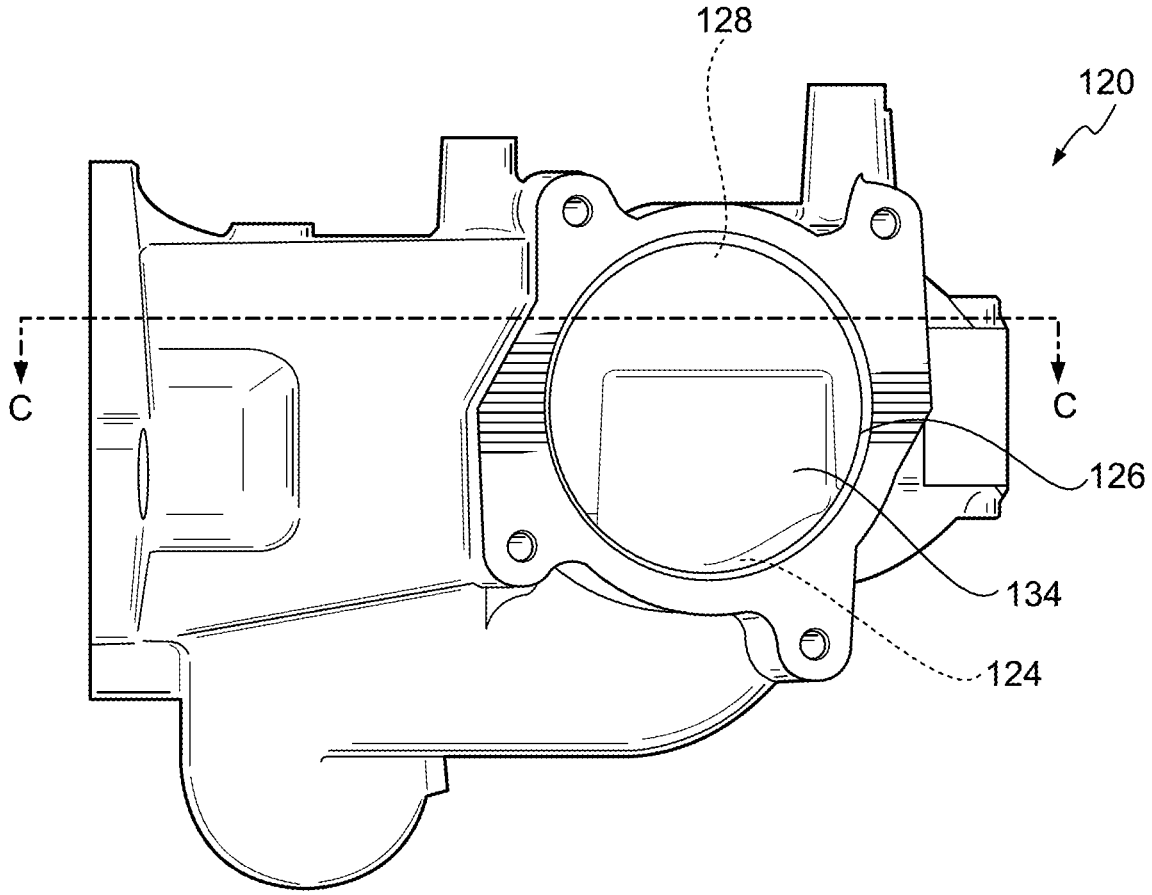
FIG. 10 is a left side view of the intake manifold shown in FIG. 6.

The intake manifold body 122 also includes an outlet body 128 (e.g., portion, etc.) (shown in detail in FIG. 7). As shown in FIG. 4, the outlet body 128 is contiguous with the air inlet body 124 and is coupled to the first side of the cylinder head 114. The outlet body 128 includes an outlet body inner surface 130. As is explained in more detail herein, the air and the exhaust gas flows within the outlet body 128 along the outlet body inner surface 130.

The outlet body 128 also includes an outlet body opening 132 (e.g., aperture, hole, port, etc.). The outlet body opening 132 is disposed on the outlet body inner surface 130. As is explained in more detail herein, the outlet body opening 132 facilitates flow of the exhaust gas into the outlet body 128. The outlet body opening 132 may be variously shaped. In various embodiments, the outlet body opening 132 is elliptical. However, in other embodiments, the outlet body opening 132 is circular, oval, triangular, square, rectangular, hexagonal, pentagonal, or otherwise similarly shaped.

The outlet body 128 also includes an outlet body wall 134 (e.g., mixer, rib, projection, etc.). The outlet body wall 134 extends from the outlet body inner surface 130 and around at least a portion of the outlet body opening 132. At least a portion of the outlet body wall 134 inhibits flow of the air across the outlet body opening 132. The outlet body wall 134 also enables a portion of the air to flow around the outlet body opening 132. Additionally, and as described in more detail herein, the outlet body wall 134 facilitates mixing of the air and the exhaust gas downstream of the outlet body opening 132. By facilitating mixing of the exhaust gas and the air, a relatively concentration of the exhaust gas (in the mixture of the air and the exhaust gas) that is provided to one cylinder of the internal combustion engine system 100 may be approximately equal to a relatively concentration of the exhaust gas (in the mixture of the air and the exhaust gas) that is provided to another cylinder of the internal combustion engine system 100. In this way, combustion in both cylinders may occur similarly (e.g., produce approximately equal heat, produce approximately equal power, etc.), which may mitigate wear of various components of the internal combustion engine system 100. As a result, the internal combustion engine system 100 may be more desirable than other systems that do not facilitate mixing of exhaust gas and air.

Figure 11:
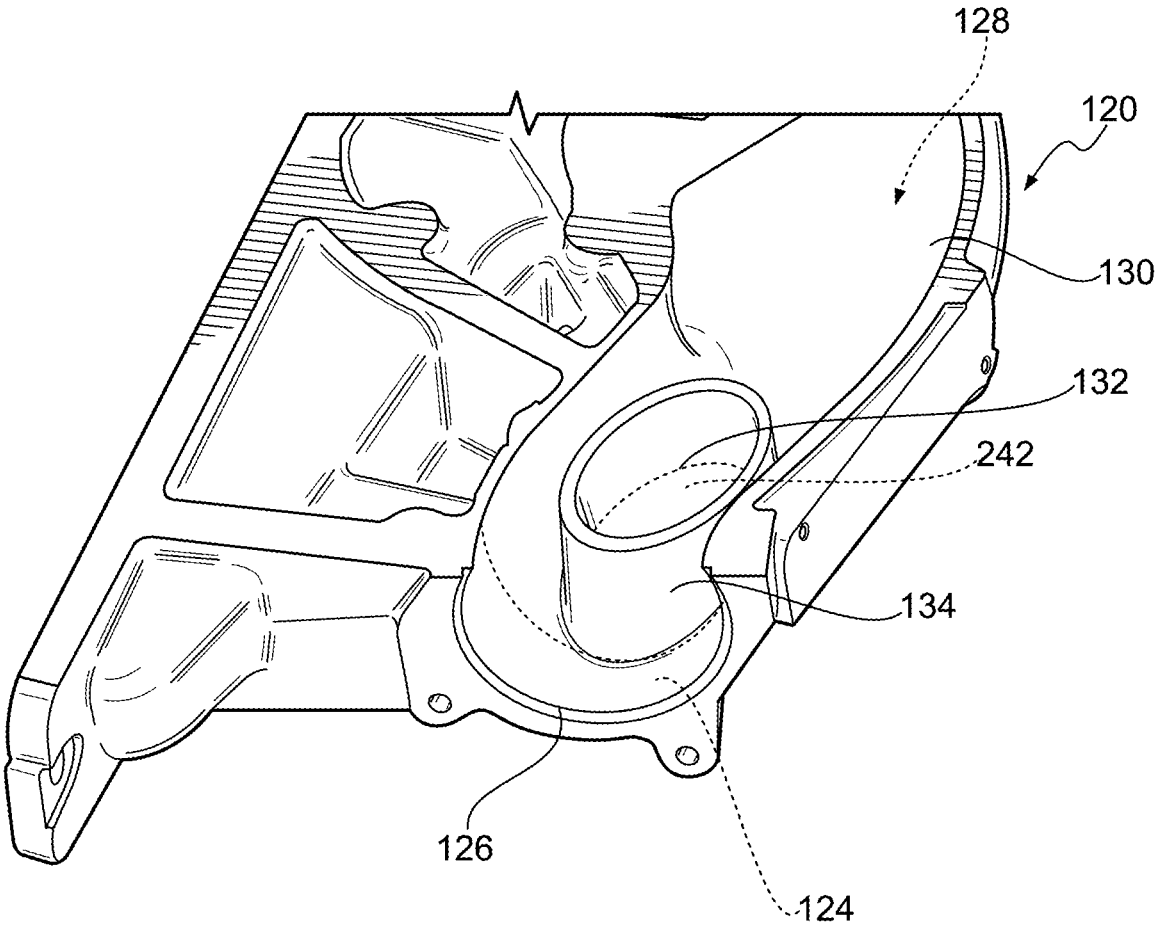
FIG. 11 is a cross-sectional view of a portion of the intake manifold shown in FIG. 6 taken along plane C-C.

In various embodiments, such as is shown in FIG. 11, the outlet body wall 134 extends entirely around the outlet body opening 132. In these embodiments, the outlet body opening 132 may be elliptical. However, the outlet body opening 132 may also be circular, oval, triangular, square, rectangular, hexagonal, pentagonal, or otherwise similarly shaped.

In some embodiments, the outlet body wall 134 extends around only a portion (e.g., upstream portion, upstream half, etc.) of the outlet body opening 132, etc.). In these embodiments, at least a portion of the outlet body wall 134 is disposed upstream of the outlet body opening 132. This portion of the outlet body wall 134 inhibits flow of the air across the outlet body opening 132 and enables a portion of the air to flow around the outlet body opening 132. For example, the outlet body wall 134 may extend around a portion of a circumference of the outlet body opening 132, where the portion is approximately (e.g., within 5% of, etc.) in a range of 10% of the circumference of the outlet body opening 132 to 80% of the circumference of the outlet body opening 132, inclusive.

The outlet body wall 134 is defined by a height that the outlet body wall 134 extends from the outlet body inner surface 130. In various embodiments, the height of the outlet body wall 134 is approximately in a range of 25 millimeters (mm) to 50 mm, inclusive. In more particular embodiments, the height of the outlet body wall 134 is approximately in a range of 35 mm to 45 mm, inclusive. The outlet body 128 may be variously configured such that the effects of the outlet body wall 134 on the flow of the air within the outlet body 128 are tailored for a target application.

The intake manifold body 122 also includes an intake manifold outlet 136 that extends through the outlet body 128. The intake manifold outlet 136 provides the air and the exhaust gas from the intake manifold body 122 to the cylinder head 114. The cylinder head 114 is coupled to the outlet body 128 around the intake manifold outlet 136. The mixture of the air and exhaust gas is provided from the outlet body 128 to the cylinder head 114 via the intake manifold outlet 136.

The internal combustion engine system 100 includes a plurality of cylinders (e.g., two cylinders, four cylinders, five cylinders, six cylinders, seven cylinders, eight cylinders, nine cylinders, ten cylinders, twelve cylinders, fourteen cylinders, etc.) and a fuel system that provides fuel to each of the cylinders. The cylinder head 114 also provides the mixture of the air and the exhaust gas from the outlet body 128 to one or more of the cylinders. For example, where the internal combustion engine system 100 includes five cylinders, the cylinder head 114 provides the mixture of the air and the exhaust gas to one or more of the five cylinders. The internal combustion engine system 100 combusts the fuel and the mixture of the air and the exhaust gas, which produces exhaust gas. In some applications, one or more cylinders of the internal combustion engine system 100 do not receive exhaust gas and instead only receive air. For example, an internal combustion engine system 100 may include six cylinders, three of which receive air and exhaust gas, and three of which only receive air.

The internal combustion engine system 100 also includes an exhaust manifold 138 (e.g., outlet manifold, etc.). The exhaust manifold 138 is coupled to a second side (e.g., hot side, exhaust side, etc.) of the cylinder head 114 and is configured to receive the exhaust gas from the cylinder head 114. The exhaust manifold 138 is configured to receive the exhaust gas from each of the cylinders of the internal combustion engine system 100. The exhaust manifold 138 is coupled to an outlet exhaust gas conduit and configured to provide the exhaust gas to the outlet exhaust gas conduit. The outlet exhaust gas conduit may provide the exhaust gas to an aftertreatment system (e.g., a system that doses the exhaust gas with reductant and provides the exhaust gas through a catalyst member, etc.) and/or a filtration system (e.g., a particulate filter, etc.). In some embodiments, the internal combustion engine system 100 includes a turbocharger and the exhaust gas is provided from the exhaust manifold 138 to the turbocharger and from the turbocharger to the outlet exhaust gas conduit.

The intake manifold assembly 103 also includes an exhaust gas recirculation (EGR) system 140. As is explained in more detail herein, the EGR system 140 provides the exhaust gas from the exhaust manifold 138 to the intake manifold 120. The intake manifold assembly 103 provides the exhaust gas produced by the cylinders back into the cylinders, which reduces a temperature of combustion (e.g., due to relatively decreased proportion of air in the combined air and exhaust gas combusted in the cylinders, etc.). As a result, production of undesirable byproducts (e.g., nitrogen oxides ($NO_x$), etc.) by the internal combustion engine system 100 may be reduced compared to a system that does not provide exhaust gas to cylinders for combustion.

Figure 5:
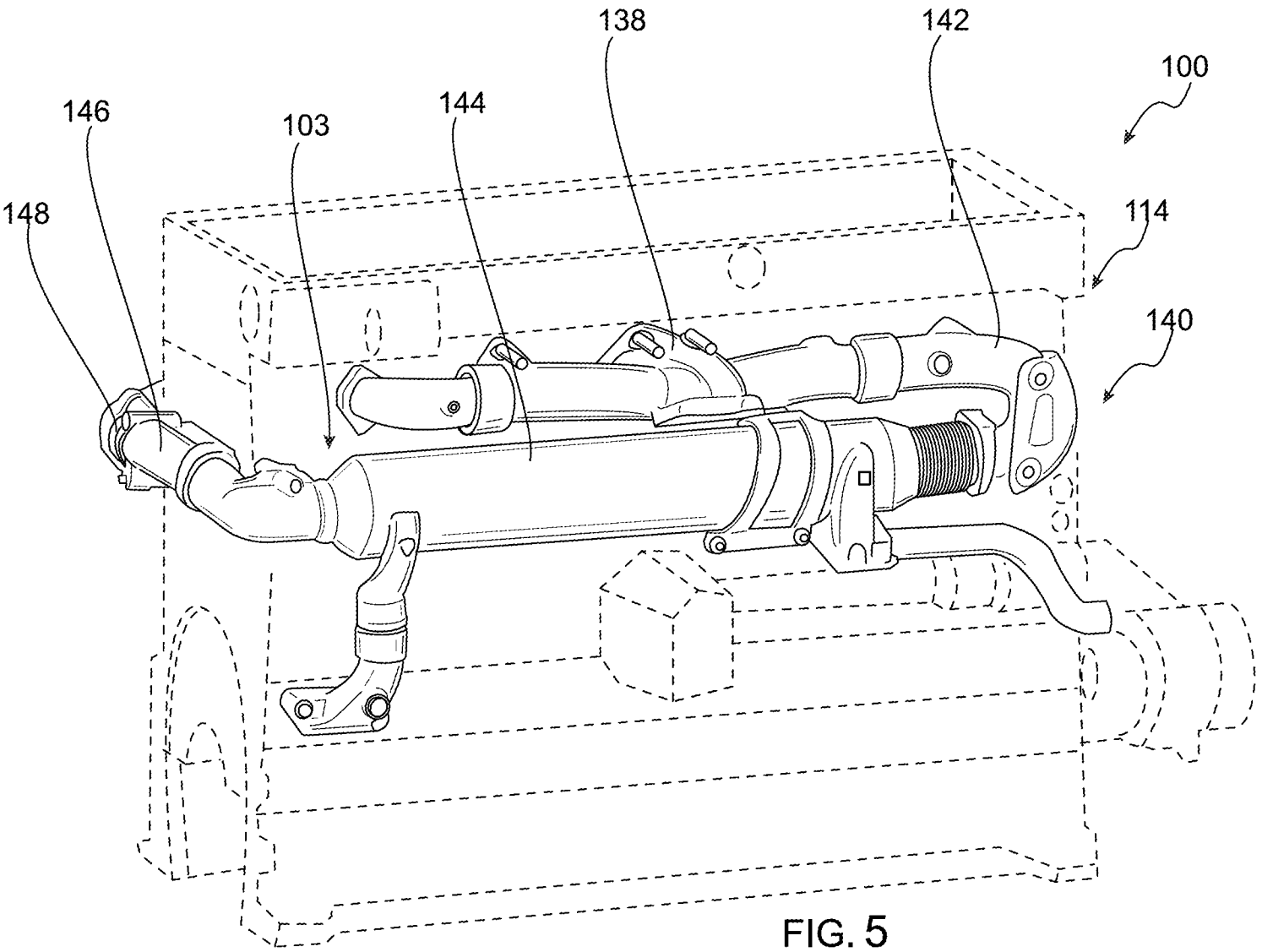
FIG. 5 is yet another perspective view of the internal combustion engine system shown in FIG. 1.
Figure 6:
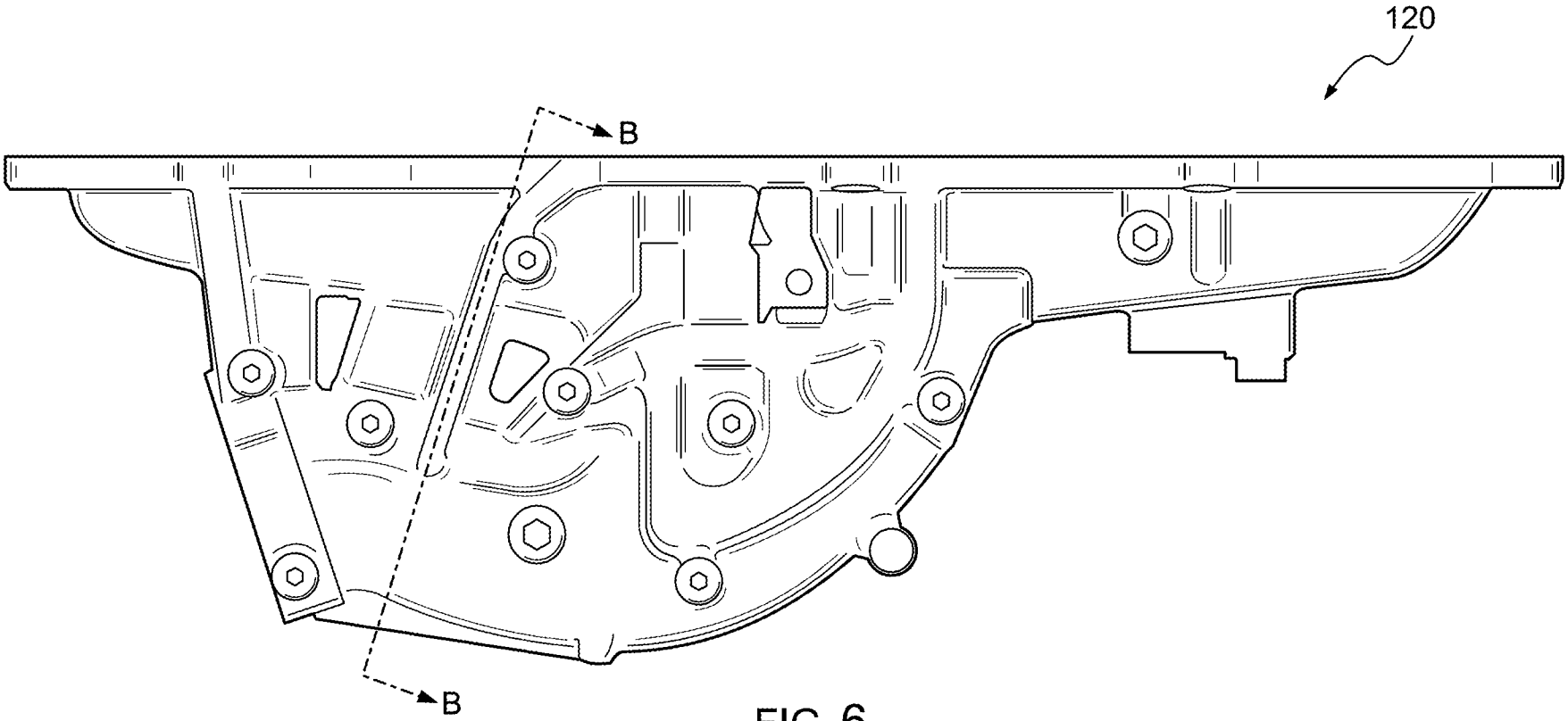
FIG. 6 is a top view of an intake manifold of the intake manifold assembly of FIG. 1.

As shown in FIG. 5, the EGR system 140 includes an EGR elbow 142. The EGR elbow 142 is coupled to the exhaust manifold 138 and is configured to receive the exhaust gas from the exhaust manifold 138. The EGR system 140 also includes a fluid heat exchanger 144. The fluid heat exchanger 144 is coupled to the EGR elbow 142 and is configured to receive the exhaust gas from the EGR elbow 142. Additionally, the fluid heat exchanger 144 is configured to receive a fluid (e.g., engine coolant, etc.) from a fluid system of the internal combustion engine system 100, facilitate exchange of heat from the exhaust gas to the fluid, and to provide the fluid back to the fluid system (e.g., after being heated by the exhaust gas, etc.).

The EGR system 140 also includes a transfer pipe 146, as shown in FIG. 1. The transfer pipe 146 is coupled to the fluid heat exchanger 144 and is configured to receive the exhaust gas from the fluid heat exchanger 144. The EGR system 140 also includes an upstream seal joint 148. The upstream seal joint 148 is coupled to the transfer pipe 146. The EGR system also includes a crossover pipe 150. The crossover pipe 150 is coupled to the upstream seal joint 148 and is configured to receive exhaust gas from the transfer pipe 146 after the exhaust gas flows through the upstream seal joint 148. In various embodiments, the upstream seal joint 148 is a spherical seal joint. As is also shown in FIG. 1, the EGR system 140 also includes a downstream seal joint 152. The downstream seal joint 152 is coupled to the crossover pipe 150. The EGR system 140 also includes an EGR adaptor 154. The EGR adaptor is coupled to the downstream seal joint 152 and is configured to receive the exhaust gas from the crossover pipe 150 after the exhaust gas flows through the downstream seal joint 152. In various embodiments, the downstream seal joint 152 is a spherical seal joint.

As shown in FIG. 1, the EGR system 140 also includes an EGR throttle 156 (e.g., valve, throttle valve, electronic valve, intake throttle, valve assembly etc.). The EGR throttle 156 includes an EGR throttle body 158 (e.g., frame, etc.). The EGR throttle body 158 is coupled to the EGR adaptor 154 and is configured to receive the exhaust gas from the EGR adaptor 154. In various embodiments, the EGR throttle body 158 is made from aluminum.

Figure 14:
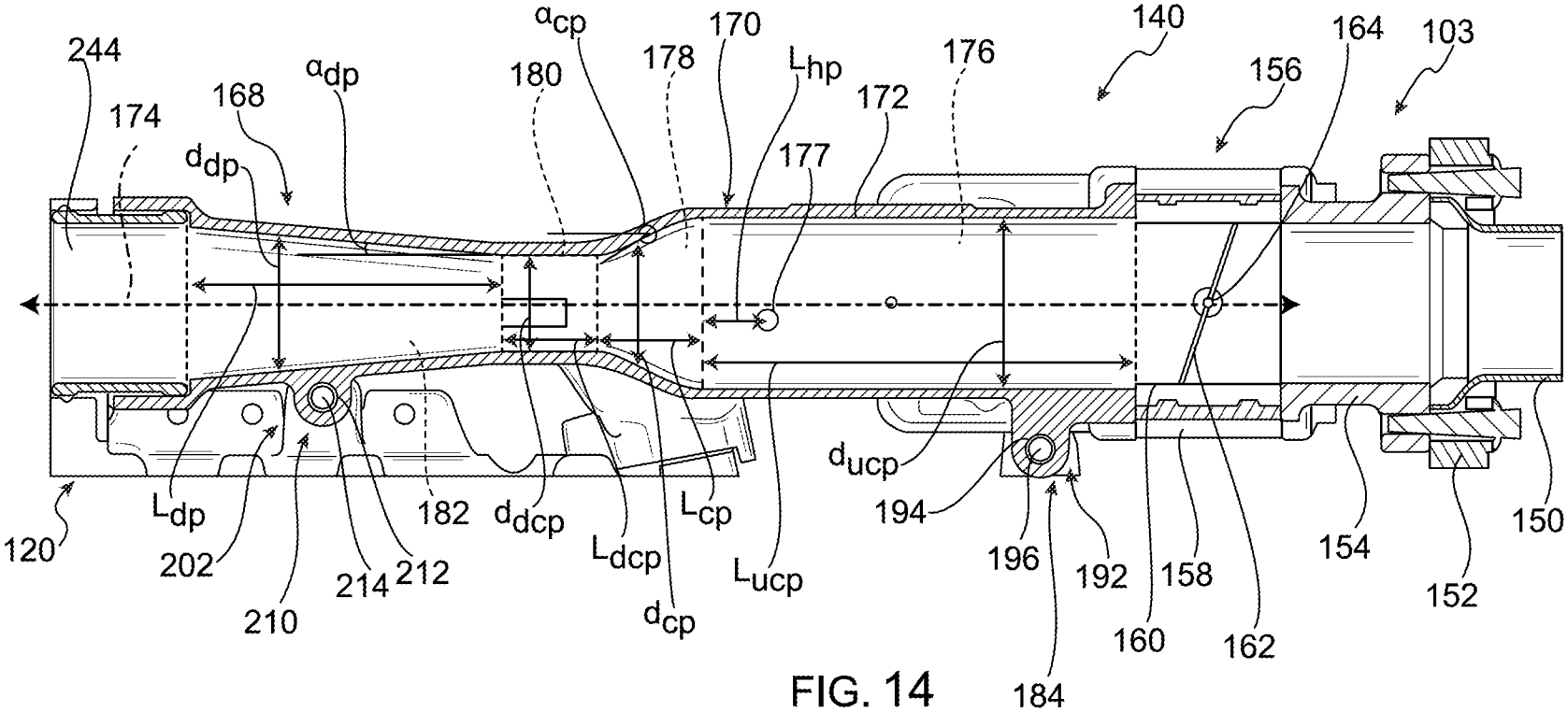
FIG. 14 is a cross-sectional view of a portion of the intake manifold assembly shown in FIG. 13 taken along plane D-D.

As shown in FIG. 14, the EGR throttle 156 also includes an EGR throttle opening 160 (e.g., bore, etc.). The EGR throttle opening 160 extends through the EGR throttle body 158. The EGR throttle opening 160 is configured to receive the exhaust gas from the EGR adaptor 154 and provide the exhaust gas through the EGR throttle body 158. The EGR throttle 156 also includes an EGR throttle plate 162 (e.g., valve member, etc.). The EGR throttle plate 162 is disposed within the EGR throttle opening 160 and is rotatable within the EGR throttle opening 160 to control flow of the exhaust gas through the EGR throttle opening 160. The EGR throttle 156 also includes an EGR throttle shaft 164. The EGR throttle shaft 164 extends through at least a portion of the EGR throttle body 158 and is coupled to the EGR throttle plate 162 such that the rotation of the EGR throttle shaft 164 causes rotation of the EGR throttle plate 162 within the EGR throttle opening 160.

Figure 13:
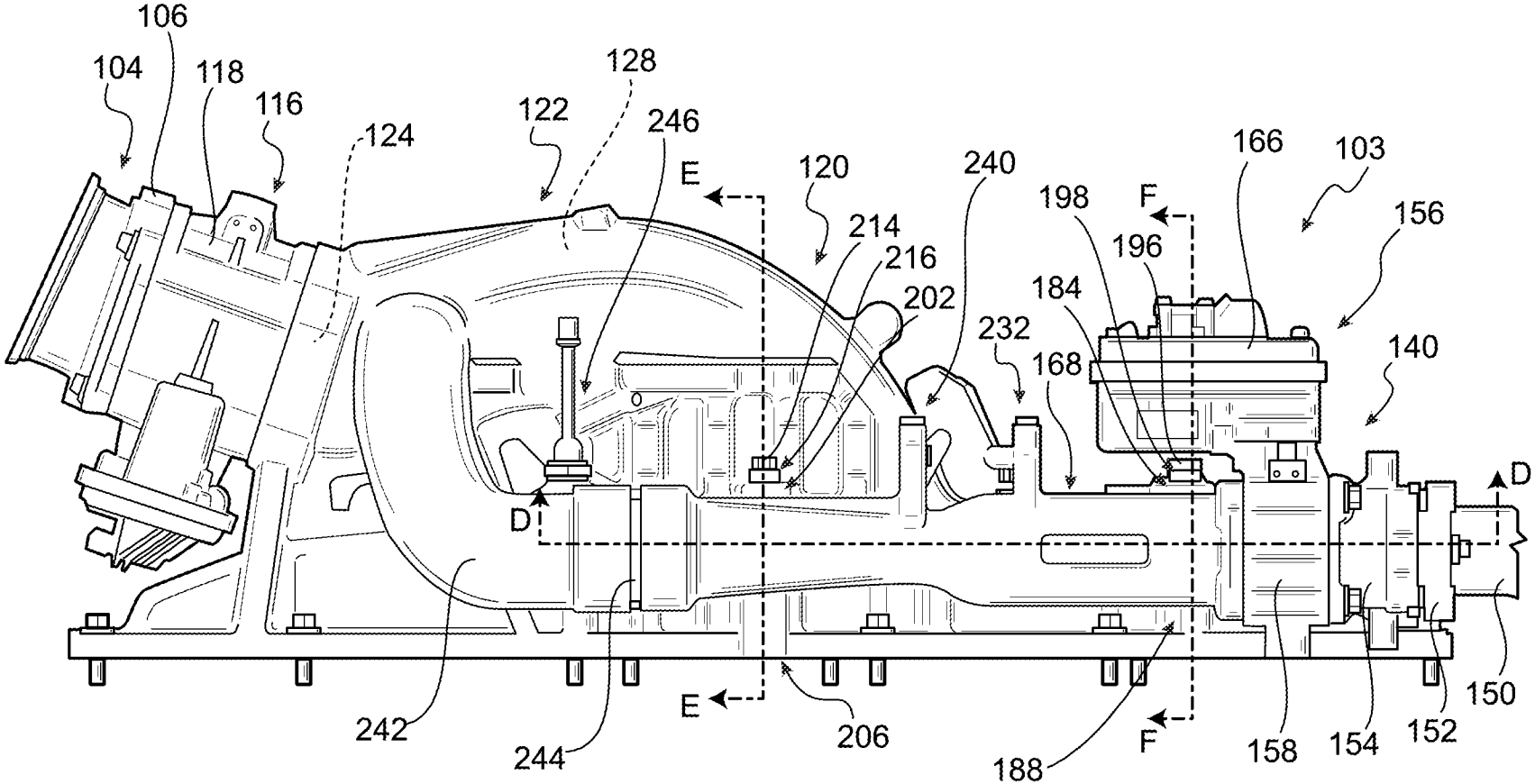
FIG. 13 is a bottom view of the intake manifold assembly shown in FIG. 12.

The EGR throttle 156 also includes an EGR throttle actuator 166 (e.g., solenoid, linear actuator, rotary actuator, etc.), as shown in FIG. 13. The EGR throttle actuator 166 is configured to cause rotation of the EGR throttle shaft 164 and therefore rotation of the EGR throttle plate 162. The EGR throttle actuator 166 is operable between a first position, where the EGR throttle plate 162 inhibits flow of the exhaust gas through the EGR throttle body 158 (e.g., less than 1% of the exhaust that is received by the EGR throttle opening 160 flows between the EGR throttle plate 162 and the EGR throttle body 158, etc.), and a second position, where the EGR throttle plate 162 does not inhibit flow of the exhaust gas through the EGR throttle body 158.

As shown in FIG. 13, the EGR system 140 also includes a venturi 168 (e.g., ejector, flow concentrator, etc.). The venturi 168 includes a venturi body 170 (e.g., frame, etc.). The venturi 168 also includes a venturi opening 172 (e.g., bore, etc.) extending through the venturi body 170. The venturi opening 172 is configured to receive the exhaust gas from the EGR throttle opening 160 and provide the exhaust gas through the venturi 168. The venturi opening 172 is centered on a venturi center axis 174 (e.g., a center point of the venturi opening 172 is disposed on the venturi center axis 174, etc.). In some embodiments, the EGR throttle 156 is configured such that the EGR throttle shaft 164 is intersected by the venturi center axis 174. For example, the EGR throttle plate 162 may be rotated around an axis (e.g., a center axis of the EGR throttle shaft 164) that is orthogonal to the venturi center axis 174 (e.g., when measured on a plane along which the venturi center axis 174 and the axis around which the EGR throttle plate 162 is rotated, etc.). As a result of this configuration, the EGR throttle 156 is operable to control flow of the exhaust gas through the venturi body 170.

In some applications, the venturi 168 is made from stainless steel. For example, the venturi 168 may be cast from stainless steel. The venturi body 170 is defined by a wall thickness $t_W$. In various embodiments, the wall thickness $t_W$ is approximately in a range of 2 mm to 5 mm, inclusive. For example, the wall thickness $t_W$ may be approximately equal to 3.5 mm.

Figure 24:
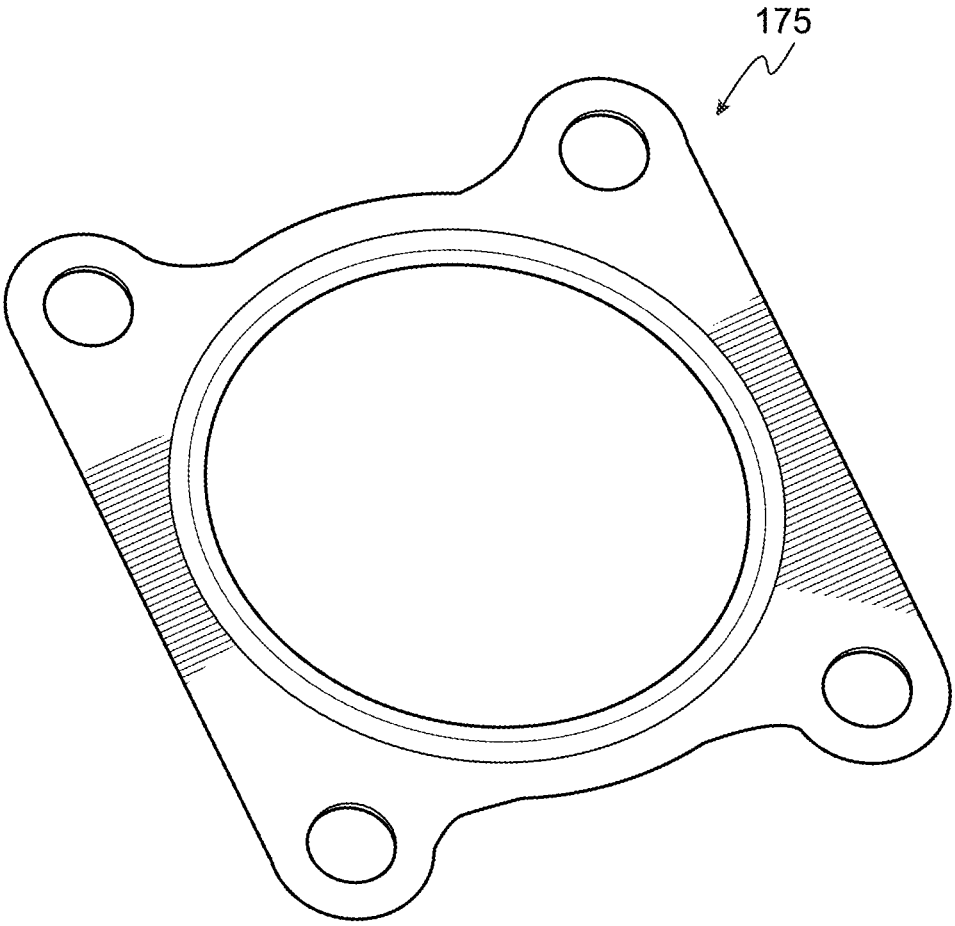
FIG. 24 is a perspective view of an EGR gasket of the intake manifold assembly of FIG. 1.

As shown in FIG. 24, the EGR system 140 also includes an EGR gasket 175. The EGR gasket 175 is disposed between the venturi body 170 and the EGR throttle body 158. The EGR gasket 175 cooperates with the EGR throttle body 158 and the venturi body 170 to establish a seal (e.g., an exhaust gas-tight seal) between the venturi body 170 and the EGR throttle body 158.

Referring to FIG. 14, the venturi body 170 includes an upstream cylindrical portion 176 (e.g., tubular portion, etc.). The upstream cylindrical portion 176 is immediately downstream of the EGR throttle 156 and is configured to receive the exhaust gas from the EGR throttle opening 160. The upstream cylindrical portion 176 has an upstream cylindrical portion length $L_{ucp}$ measured along the venturi center axis 174. In various embodiments, the upstream cylindrical portion length $L_{ucp}$ is approximately in a range of 120 mm to 160 mm, inclusive. For example, the upstream cylindrical portion length $L_{ucp}$ may be approximately equal to 144 mm. The upstream cylindrical portion 176 also has an upstream cylindrical portion diameter $d_{ucp}$ that is substantially constant along the upstream cylindrical portion length $L_{ucp}$. As used herein, "substantially constant" is intended to describe a value that varies by less than 5%. For example, where a value is 100 mm that is substantially constant along a distance, the value may also be 95 mm at one location along the distance, 100 mm at another location along the distance, and 105 mm at yet another location along the distance. In various embodiments, the upstream cylindrical portion diameter $d_{ucp}$ is approximately in a range of 40 mm to 70 mm, inclusive. For example, the upstream cylindrical portion diameter $d_{ucp}$ may be approximately equal to 56 mm.

As is shown in FIG. 14, the venturi body 170 also includes a highside passageway 177 (e.g., bore, port, aperture, etc.). The highside passageway 177 is separated from a downstream end of the upstream cylindrical portion 176 by a highside passageway length $L_{hp}$. The highside passageway length $L_{hp}$ is approximately in a range of 18 mm to 26 mm, inclusive. The highside passageway length $L_{hp}$ may be approximately equal to 22 mm. The highside passageway 177 may facilitate mass measurement of the exhaust gas (e.g., in conjunction with a sensor coupled to the venturi body 170, etc.). The highside passageway 177 may also facilitate measurement of pressure the exhaust gas. The highside passageway 177 can be formed by various processes, such as boring, drilling, additive manufacturing (e.g., where material is intentionally not added in a volume so as to form the highside passageway 177, etc.), and other similar processes.

The highside passageway 177 facilitates flow of the exhaust gas from the upstream cylindrical portion 176 through the venturi body 170 and out of the venturi 168. The highside passageway 177 is centered on an axis that is angularly separated from a horizontal axis (that is orthogonal to the venturi center axis 174) by an angular separation. In various embodiments, the angular separation is approximately equal to 12°. The angular separation may facilitate drainage of condensation from the highside passageway 177.

The venturi body 170 also includes a convergent portion 178 (e.g., sloped portion, etc.), as shown in FIG. 14. The convergent portion 178 is contiguous with the upstream cylindrical portion 176 and is configured to receive the exhaust gas from the upstream cylindrical portion 176. The convergent portion 178 has a convergent portion length $L_{cp}$ measured along the venturi center axis 174. In various embodiments, the convergent portion length $L_{cp}$ is approximately in a range of 20 mm to 50 mm, inclusive. For example, the convergent portion length $L_{cp}$ may be approximately equal to 35 mm. In other applications, the convergent portion length $L_{cp}$ may be approximately equal to 28 mm, 29 mm, 30 mm, or 31 mm. The convergent portion 178 extends from the upstream cylindrical portion 176 towards the venturi center axis 174. Thus, the slope of the convergent portion 178 is negative and a convergent portion diameter $d_{cp}$ of the convergent portion 178 decreases along the convergent portion length $L_{cp}$. The convergent portion length $L_{cp}$ is less than the upstream cylindrical portion length $L_{ucp}$.

In various embodiments, such as is shown in FIG. 14, the slope of the convergent portion 178 varies along the convergent portion length $L_{cp}$. Specifically, the slope of the convergent portion 178 is greatest proximate an inlet end and an outlet end of the convergent portion 178, and is least proximate a middle of the convergent portion 178. As a result, the convergent portion 178 gradually converges towards the venturi center axis 174 (proximate the inlet end of the convergent portion 178), rapidly converges towards the venturi center axis 174 (proximate the middle of the convergent portion 178), and then gradually converses towards the venturi center axis 174 (proximate the outlet end of the convergent portion 178).

In various embodiments, a minimum angle $\alpha_{cp}$ of the convergent portion 178 relative to the venturi center axis 174 is approximately in a range of 280 degrees (°) to 320°, inclusive. The minimum angle $\alpha_{cp}$ is located at the middle of the convergent portion 178. For example, the minimum angle $\alpha_{cp}$ may be approximately equal to 294 °.

As shown in FIG. 14, the venturi body 170 also includes a downstream cylindrical portion 180 (e.g., tubular portion, orifice, throat, etc.). The downstream cylindrical portion 180 is contiguous with the convergent portion 178 and is configured to receive the exhaust gas from the convergent portion 178. The downstream cylindrical portion 180 has a downstream cylindrical portion length $L_{dcp}$ measured along the venturi center axis 174. In various embodiments, the downstream cylindrical portion length $L_{dcp}$ is approximately in a range of 20 mm to 45 mm, inclusive. For example, the downstream cylindrical portion length $L_{dcp}$ may be approximately equal to 32 mm. In other applications, the downstream cylindrical portion length $L_{dcp}$ may be approximately equal to 28 mm, 29 mm, 30 mm, or 31 mm. The downstream cylindrical portion length $L_{dcp}$ is less than the upstream cylindrical portion length $L_{ucp}$. In some embodiments, the downstream cylindrical portion length $L_{dcp}$ is less than the convergent portion length $L_{cp}$.

Referring to FIG. 14, the downstream cylindrical portion 180 also has a downstream cylindrical portion diameter $d_{dcp}$ that is substantially constant along the downstream cylindrical portion length $L_{dcp}$. In some embodiments, the downstream cylindrical portion diameter $d_{dcp}$ is approximately equal to the downstream cylindrical portion length $L_{dcp}$. The downstream cylindrical portion diameter $d_{dcp}$ is less than the upstream cylindrical portion diameter $d_{ucp}$. In various embodiments, the downstream cylindrical portion diameter $d_{dcp}$ is approximately in a range of 45% of the upstream cylindrical portion diameter $d_{ucp}$ and 65% of the upstream cylindrical portion diameter $d_{ucp}$, inclusive. For example, the downstream cylindrical portion diameter $d_{dcp}$ may be approximately equal to 57% of the upstream cylindrical portion diameter $d_{ucp}$. In various embodiments, the downstream cylindrical portion diameter $d_{dcp}$ is approximately in a range of 20 mm to 45 mm, inclusive. For example, the downstream cylindrical portion diameter $d_{dcp}$ may be approximately equal to 32 mm.

Figure 23:
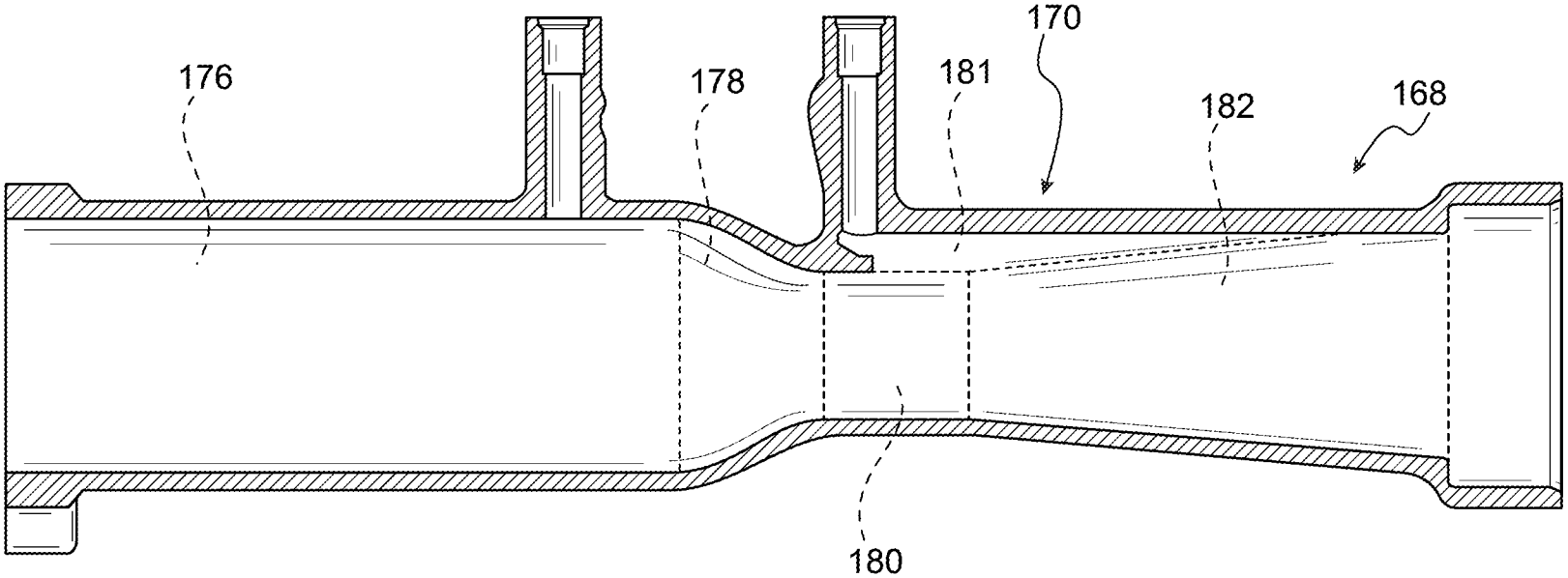
FIG. 23 is a cross-sectional view of the venturi shown in FIG. 22 taken along plane J-J.

As shown in FIG. 23, the venturi body 170 also includes a slot portion 181. The slot portion 181 is contiguous with the downstream cylindrical portion 180 and extends over a portion of the downstream cylindrical portion 180. As a result, the slot portion 181 functions to provide a gap around a portion of the downstream cylindrical portion 180. The slot portion 181 assists in providing accurate and desirable measurements of pressure changes when EGR flow is traveling backwards (e.g., from the divergent portion 182 to the upstream cylindrical portion 176).

The venturi body 170 also includes a divergent portion 182 (e.g., sloped portion, etc.), as shown in FIG. 14. The divergent portion 182 is contiguous with the downstream cylindrical portion 180 and the slot portion 181. The slot portion 181 extends over a portion of the divergent portion 182, as shown in FIG. 23. The divergent portion 182 is configured to receive the exhaust gas from the downstream cylindrical portion 180. The divergent portion 182 has a divergent portion length $L_{dp}$ measured along the venturi center axis 174. In various embodiments, the divergent portion length $L_{dp}$ is approximately in a range of 90 mm to 150 mm, inclusive. For example, the divergent portion length $L_{dp}$ may be approximately equal to 137 mm. The divergent portion 182 extends from the downstream cylindrical portion 180 away from the venturi center axis 174. Thus, the slope of the divergent portion 182 is positive and a divergent portion diameter $d_{dp}$ of the divergent portion 182 increases along the divergent portion length $L_{dp}$. In various embodiments, the slope of the divergent portion 182 is substantially constant along the divergent portion length $L_{dp}$ and the divergent portion 182 is angularly separated from the venturi center axis 174 by a divergent portion angle $\alpha_{dp}$. In various embodiments, the divergent portion angle $\alpha_{dp}$ is approximately in a range of 5° to 15°, inclusive. For example, the divergent portion angle $\alpha_{dp}$ may be approximately equal to 10°. The divergent portion length $L_{dp}$ is greater than the convergent portion length $L_{cp}$ and the downstream cylindrical portion length $L_{dcp}$. In various embodiments, the divergent portion length $L_{dp}$ is less than the upstream cylindrical portion length $L_{ucp}$.

The venturi body 170 is coupled to the intake manifold body 122. As a result, the venturi body 170 is coupled to the cylinder head 114 via the intake manifold body 122. However, as is explained in more detail herein, the coupling between the venturi body 170 and the intake manifold body 122 is configured to mitigate transfer of vibrations from the cylinder head 114 to the venturi body 170 (e.g., by achieving a target modal frequency, etc.). Additionally, the coupling between the venturi body 170 and the intake manifold body 122 supports the venturi body 170 on both an upstream end of the venturi body 170 and a downstream end of the venturi body 170, which ensures prolonged desirable operation of the internal combustion engine system 100.

As shown in FIG. 14, the intake manifold body 122 also includes an upstream intake flange 184 (e.g., ring, collar, etc.). The upstream intake flange 184 includes an upstream intake flange aperture 186 (e.g., hole, etc.). The upstream intake flange aperture 186 is directed towards the cylinder head 114 when the intake manifold body 122 is coupled to the cylinder head 114. The intake manifold body 122 also includes an upstream boss 188 (e.g., projection, etc.), as shown in FIG. 13. The upstream boss 188 includes an upstream boss aperture 190 (e.g., hole, etc.). The upstream boss aperture 190 is directed towards the cylinder head 114 when the intake manifold body 122 is coupled to the cylinder head 114. The upstream boss 188 is configured such that the upstream boss aperture 190 is aligned with the upstream intake flange aperture 186. The upstream boss aperture 190 has a diameter that is smaller than a diameter of the upstream intake flange aperture 186.

The venturi body 170 also includes an upstream venturi flange 192 (e.g., ring, flange, etc.), as shown in FIG. 14. The upstream venturi flange 192 is configured to be received between the upstream intake flange 184 and the upstream boss 188. The upstream venturi flange 192 includes a upstream venturi flange aperture 194 (e.g., hole, etc.). The upstream venturi flange aperture 194 is directed towards the cylinder head 114 when the venturi body 170 is coupled to the intake manifold body 122 and the intake manifold body 122 is coupled to the cylinder head 114. The upstream venturi flange 192 is configured such that the upstream venturi flange aperture 194 is aligned with the upstream boss aperture 190 and the upstream intake flange aperture 186 when the venturi body 170 is coupled to the intake manifold body 122 and the intake manifold body 122 is coupled to the cylinder head 114. The upstream venturi flange 192 has a diameter that is smaller than a diameter of the upstream intake flange aperture 186 and is approximately equal to a diameter of the upstream boss aperture 190.

Referring to FIG. 14, the intake manifold assembly 103 also includes an upstream fastener 196 (e.g., bolt, screw, etc.). As is explained in more detail herein, the upstream fastener 196 is configured to facilitate coupling of the intake manifold body 122 to the venturi body 170 using the upstream intake flange 184, the upstream boss 188, and the upstream venturi flange 192. The upstream intake flange aperture 186, the upstream boss aperture 190, and the upstream venturi flange aperture 194 are configured to receive the upstream fastener 196. The upstream boss aperture 190 is configured to threadably engage the upstream fastener 196. For example, the upstream fastener 196 may be inserted through the upstream intake flange aperture 186 and the upstream venturi flange aperture 194 and threaded into the upstream boss aperture 190.

Figure 25:
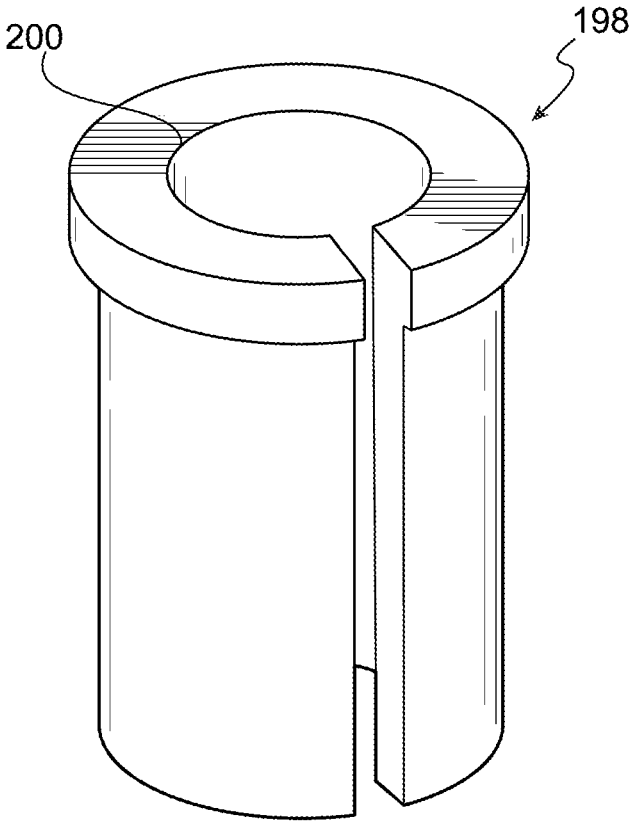
FIG. 25 is a perspective view of an upstream isolator of the intake manifold assembly of FIG. 1.
Figure 26:
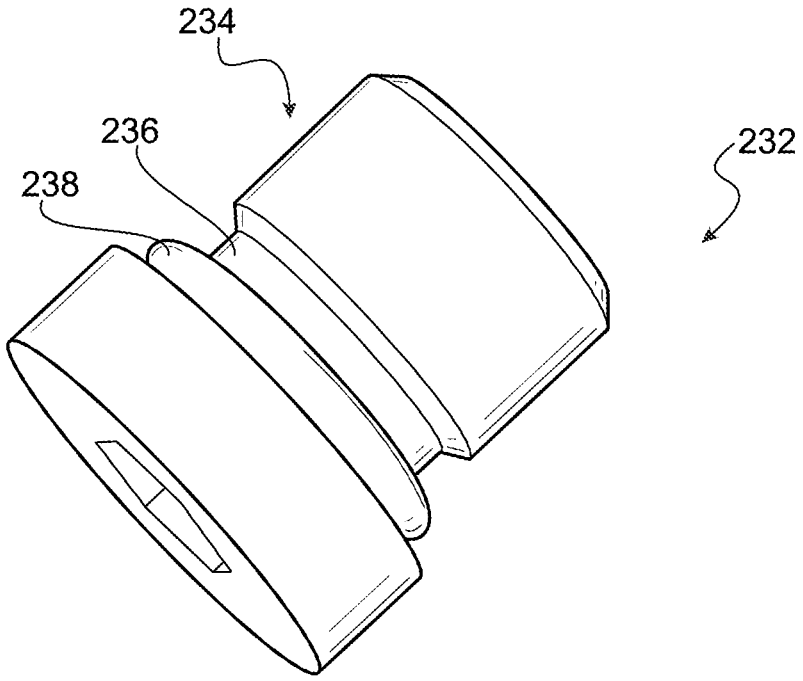
FIG. 26 is a perspective view of an upstream plug of the intake manifold assembly of FIG. 1.

The intake manifold assembly 103 also includes an upstream isolator 198 (e.g., mounting spacer, vibrational isolator, bushing, spacer, split ring, etc.), as shown in FIG. 13. The upstream isolator 198 is configured to be received within the upstream intake flange aperture 186. As shown in FIG. 25, the upstream isolator 198 includes a upstream isolator aperture 200 (e.g., hole, etc.). The upstream isolator aperture 200 is configured to receive the upstream fastener 196 when the upstream isolator 198 is received within the upstream intake flange aperture 186. The upstream isolator 198 is configured to mitigate transfer of vibrations from the cylinder head 114 to the venturi body 170 by mitigating transfer of vibrations from the upstream intake flange 184 to the upstream venturi flange 192.

In various embodiments, the upstream venturi flange aperture 194 is configured such that the upstream fastener 196 does not threadably engage the upstream venturi flange aperture 194. Similarly, in various embodiments, the upstream isolator aperture 200 is configured such that the upstream fastener 196 does not threadably engage the upstream isolator aperture 200.

As shown in FIG. 14, the intake manifold body 122 also includes a downstream intake flange 202 (e.g., ring, flange, etc.). The downstream intake flange 202 includes a downstream intake flange aperture 204 (e.g., hole, etc.). The downstream intake flange aperture 204 is directed towards the cylinder head 114 when the intake manifold body 122 is coupled to the cylinder head 114. The intake manifold body 122 also includes a downstream boss 206 (e.g., projection, etc.), as shown in FIG. 13. The downstream boss 206 includes a downstream boss aperture 208 (e.g., hole, etc.). The downstream boss aperture 208 is directed towards the cylinder head 114 when the intake manifold body 122 is coupled to the cylinder head 114. The downstream boss 206 is configured such that the downstream boss aperture 208 is aligned with the downstream intake flange aperture 204. The downstream boss aperture 208 has a diameter that is smaller than a diameter of the downstream intake flange aperture 204.

As shown in FIG. 14, the venturi body 170 also includes a downstream venturi flange 210 (e.g., ring, collar, bolted joint, etc.). The downstream venturi flange 210 is configured to be received between the downstream intake flange 202 and the downstream boss 206. The downstream venturi flange 210 includes a downstream venturi flange aperture 212 (e.g., hole, etc.). The downstream venturi flange aperture 212 is directed towards the cylinder head 114 when the venturi body 170 is coupled to the intake manifold body 122 and the intake manifold body 122 is coupled to the cylinder head 114. The downstream venturi flange 210 is configured such that the downstream venturi flange aperture 212 is aligned with the downstream boss aperture 208 and the downstream intake flange aperture 204 when the venturi body 170 is coupled to the intake manifold body 122 and the intake manifold body 122 is coupled to the cylinder head 114. The upstream venturi flange 192 has a diameter that is smaller than a diameter of the upstream intake flange aperture 186 and is approximately equal to a diameter of the downstream boss aperture 208.

The intake manifold assembly 103 also includes a downstream fastener 214 (e.g., bolt, screw, etc.), as shown in FIG. 14. As is explained in more detail herein, the downstream fastener 214 is configured to facilitate coupling of the intake manifold body 122 to the venturi body 170 using the downstream intake flange 202, the downstream boss 206, and the upstream venturi flange 192. The downstream intake flange aperture 204, the downstream boss aperture 208, and the upstream venturi flange aperture 194 are configured to receive the downstream fastener 214. The downstream boss aperture 208 is configured to threadably engage the downstream fastener 214. For example, the downstream fastener 214 may be inserted through the downstream intake flange aperture 204 and the upstream venturi flange aperture 194 and threaded into the downstream boss aperture 208.

As shown in FIG. 13, the intake manifold assembly 103 also includes a downstream isolator 216 (e.g., mounting spacer, vibrational isolator, bushing, spacer, split ring, etc.). The downstream isolator 216 is configured to be received within the downstream intake flange aperture 204. The downstream isolator 216 includes a downstream isolator aperture (e.g., hole, etc.). The downstream isolator aperture is configured to receive the downstream fastener 214 when the downstream isolator 216 is received within the downstream intake flange aperture 204. The downstream isolator 216 is configured to mitigate transfer of vibrations from the cylinder head 114 to the venturi body 170 by mitigating transfer of vibrations from the downstream intake flange 202 to the downstream venturi flange 210.

In various embodiments, the downstream venturi flange aperture 212 is configured such that the downstream fastener 214 does not threadably engage the downstream venturi flange aperture 212. Similarly, in various embodiments, the downstream isolator aperture is configured such that the downstream fastener 214 does not threadably engage the downstream isolator aperture.

Figure 20:
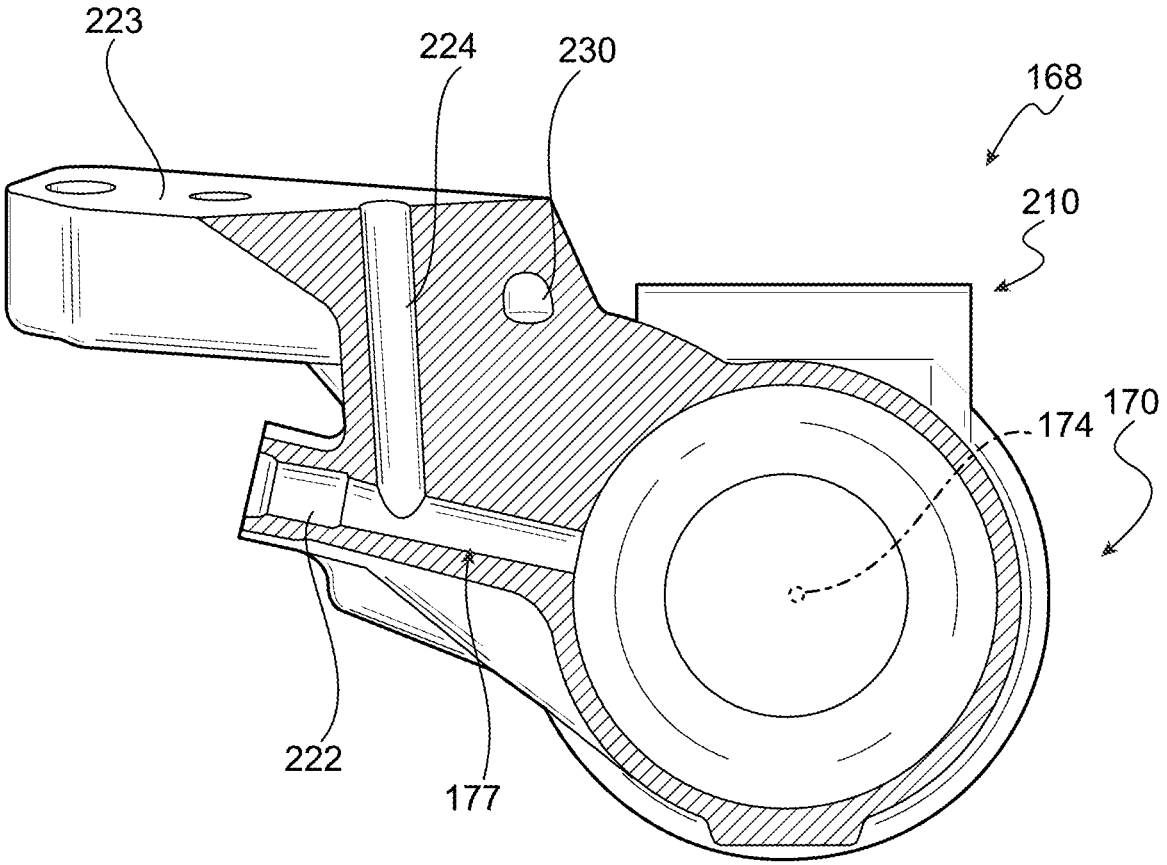
FIG. 20 is a cross-sectional view of the venturi shown in FIG. 19 taken along plane G-G.

As shown in FIG. 20, the highside passageway 177 includes an highside passageway recess 222 (e.g., hole, drilling, etc.). The highside passageway recess 222 is contiguous with (e.g., extends to, etc.) an exterior surface (e.g., outer surface, etc.) of the venturi 168. The highside passageway recess 222 can be formed by various processes, such as boring, drilling, additive manufacturing (e.g., where material is intentionally not added in a volume so as to form the highside passageway recess 222, etc.), and other similar processes. The highside passageway recess 222 can receive a plug, as described herein, for preventing flow from the highside passageway 177 out of the highside passageway 177 (e.g., via a leak, etc.).

The venturi 168 also includes a sensor mount 223 (e.g., sensor pad, etc.). The sensor mount 223 is configured to be coupled to a sensor (e.g., pressure sensor, etc.) such that the sensor is capable of obtaining a reading of a parameter (e.g., pressure, etc.) of the exhaust gas within the venturi 168. The highside passageway 177 facilitates transfer of the exhaust gas to the sensor mount 223 such that a sensor coupled to the sensor mount 223 is capable of obtaining a reading of a parameter of the exhaust gas within the venturi 168.

The venturi 168 also includes an upstream interior passageway 224 (e.g., hole, drilling, etc.), as shown in FIG. 20. The upstream interior passageway 224 extends through the venturi body 170 and is contiguous with the highside passageway 177. The upstream interior passageway 224 is centered on an axis that is angularly separated from the axis on which the highside passageway 177 is centered. In some embodiments, the angular separation is approximately equal to 43°. The angular separation may facilitate drainage of condensation from the upstream interior passageway 224. The upstream interior passageway 224 can be formed by various processes, such as boring, drilling, additive manufacture (e.g., where material is intentionally not added in a volume so as to form the upstream interior passageway 224, etc.), and other similar processes. The upstream interior passageway 224 facilitates transfer of the exhaust gas to the sensor mount 223 such that a sensor coupled to the sensor mount 223 is capable of obtaining a reading of a parameter of the exhaust gas within the venturi 168.

Figure 21:
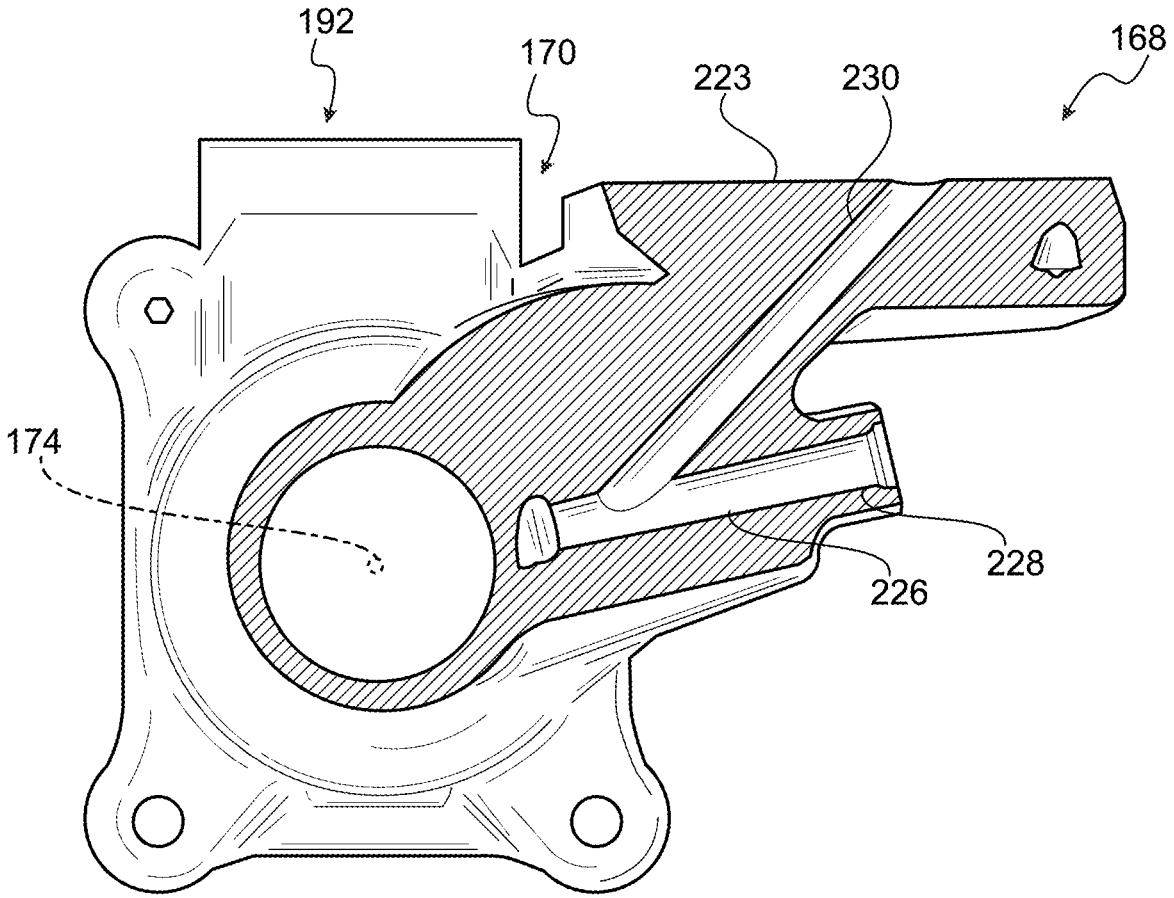
FIG. 21 is a cross-sectional view of the venturi shown in FIG. 19 taken along plane H-H.
Figure 22:
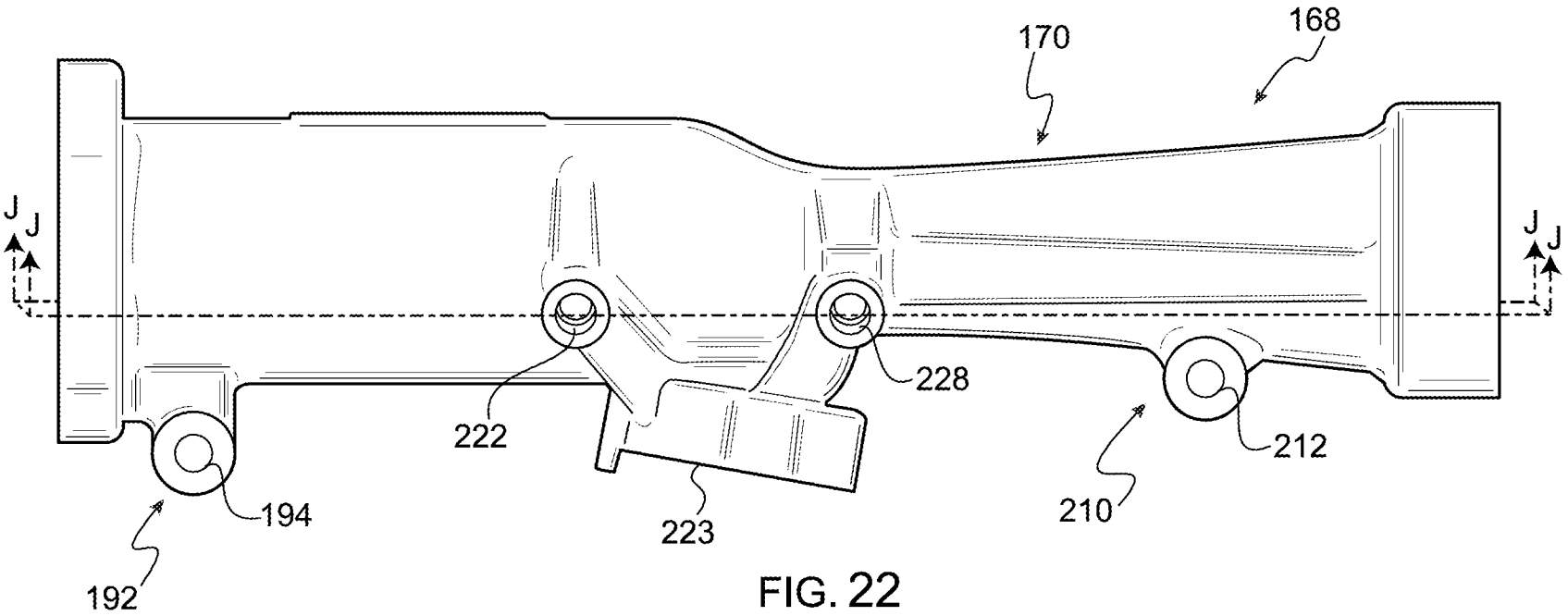
FIG. 22 is a front view of the venturi shown in FIG. 19.

As shown in FIG. 21, the venturi 168 also includes a downstream exterior passageway 226 (e.g., bore, hole, drilling, etc.). The downstream exterior passageway 226 extends through the venturi body 170 and is contiguous with the upstream cylindrical portion 176. The downstream exterior passageway 226 can be formed by various processes, such as boring, drilling, additive manufacturing (e.g., where material is intentionally not added in a volume so as to form the downstream exterior passageway 226, etc.), and other similar processes. The downstream exterior passageway 226 facilitates transfer of the exhaust gas to the sensor mount 223 such that a sensor coupled to the sensor mount 223 is capable of obtaining a reading of a parameter of the exhaust gas within the venturi 168.

The downstream exterior passageway 226 includes a downstream passageway recess 228 (e.g., bore, hole, drilling, etc.). The downstream passageway recess 228 is contiguous with an exterior surface of the venturi 168. As a result, the downstream exterior passageway 226 facilitates flow of the exhaust gas from the upstream cylindrical portion 176 through the venturi body 170 and out of the venturi 168. The downstream exterior passageway 226 is centered on an axis that is angularly separated from a horizontal axis (that is orthogonal to the venturi center axis 174) by an angular separation. In various embodiments, the angular separation is approximately equal to 12°. The angular separation may facilitate drainage of condensation from the downstream exterior passageway 226. The downstream passageway recess 228 can be formed by various processes, such as boring, drilling, additive manufacturing (e.g., where material is intentionally not added in a volume so as to form the downstream passageway recess 228, etc.), and other similar processes.

The venturi 168 also includes a downstream interior passageway 230 (e.g., bore, hole, drilling, etc.), as shown in FIG. 21. The downstream interior passageway 230 extends through the venturi body 170 and is contiguous with the downstream exterior passageway 226. The downstream interior passageway 230 is centered on an axis that is angularly separated from the axis on which the downstream exterior passageway 226 is centered. In some embodiments, the angular separation is approximately equal to 43°. The angular separation may facilitate drainage of condensation from the downstream interior passageway 230. The downstream interior passageway 230 can be formed by various processes, such as boring, drilling, additive manufacturing (e.g., where material is intentionally not added in a volume so as to form the downstream interior passageway 230, etc.), and other similar processes. The downstream interior passageway 230 facilitates transfer of the exhaust gas to the sensor mount 223 such that a sensor coupled to the sensor mount 223 is capable of obtaining a reading of a parameter of the exhaust gas within the venturi 168. In various embodiments, the slot portion 181 assists the downstream exterior passageway 226 and the downstream interior passageway 230 in measuring pressure at the downstream cylindrical portion 180.

Figure 12:
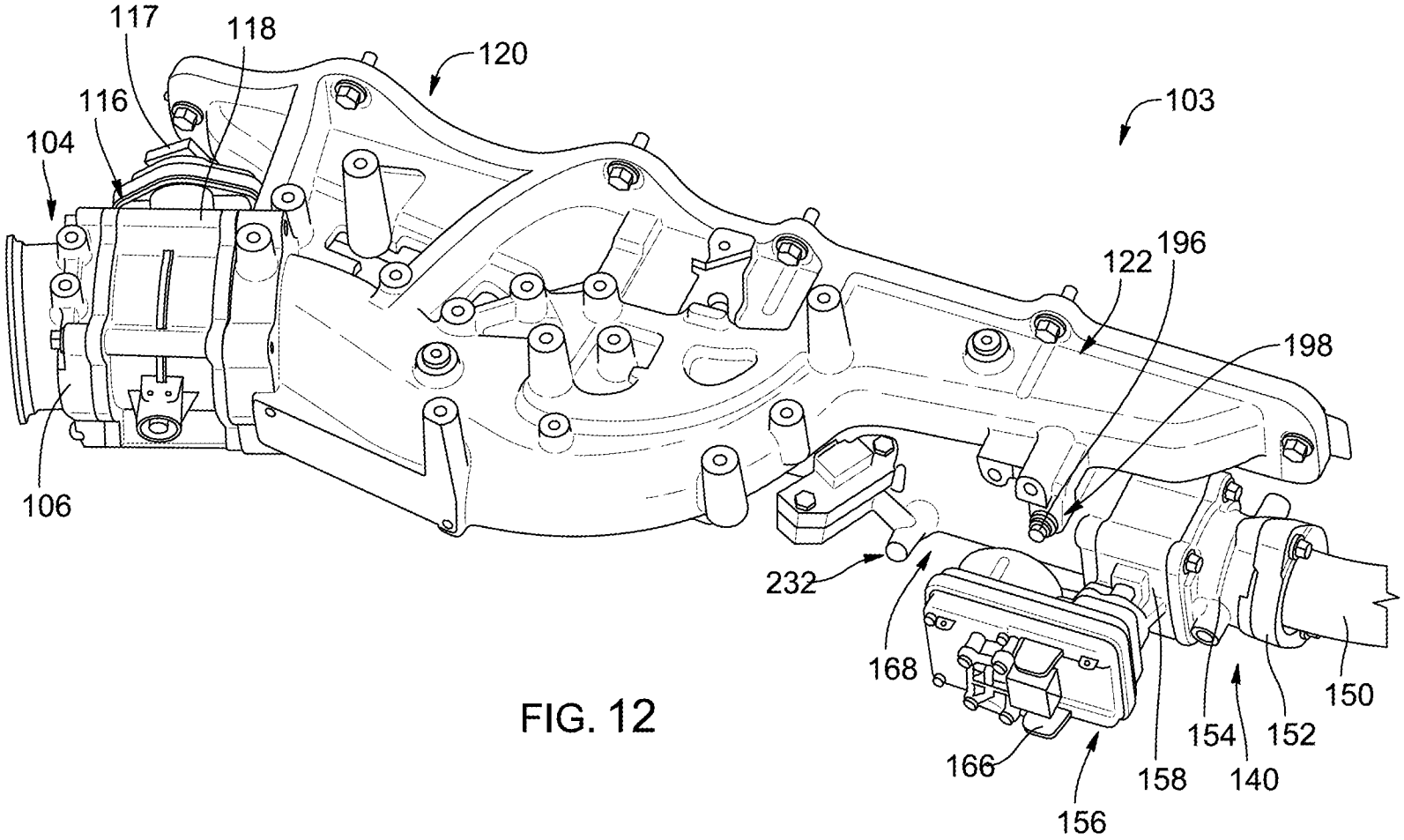
FIG. 12 is a perspective view of a portion of the intake manifold assembly of FIG. 1.

As shown in FIG. 12, the intake manifold assembly 103 also includes an upstream plug 232 (e.g., port plug, etc.). The upstream plug 232 includes an upstream plug body 234. The upstream plug body 234 is configured to be received within the highside passageway recess 222. The upstream plug body 234 includes an upstream plug groove 236 (e.g., recess, etc.). The upstream plug 232 also includes an upstream plug seal member 238 (e.g., O-ring, etc.). The upstream plug seal member 238 is configured to be received in the upstream plug groove 236. The upstream plug seal member 238 is configured to cooperate with the highside passageway recess 222 to establish a seal (e.g., exhaust gas-tight seal, etc.) between the upstream plug 232 and the highside passageway recess 222. The seal may prevent flow of the exhaust gas out of the highside passageway recess 222.

The intake manifold assembly 103 also includes a downstream plug 240 (e.g., port plug, etc.), as shown in FIG. 13. The downstream plug 240 includes a downstream plug body. The downstream plug body is configured to be received within the downstream passageway recess 228. The downstream plug body includes an upstream plug groove 236 (e.g., recess, etc.). The downstream plug 240 also includes a downstream plug seal member (e.g., O-ring, etc.). The downstream plug seal member is configured to be received in the upstream plug groove 236. The downstream plug seal member is configured to cooperate with the downstream passageway recess 228 to establish a seal (e.g., exhaust gas-tight seal, etc.) between the downstream plug 240 and the downstream passageway recess 228. The seal may prevent flow of the exhaust gas out of the downstream passageway recess 228.

As shown in FIG. 13, the intake manifold body 122 also includes an exhaust gas inlet body 242 (e.g., portion, etc.). The exhaust gas inlet body 242 is contiguous with the air inlet body 124 and the outlet body 128. The exhaust gas inlet body 242 is coupled to the venturi body 170. The exhaust gas inlet body 242 is configured to receive the exhaust gas from the divergent portion 182 and is configured to provide the exhaust gas to the outlet body opening 132. The exhaust gas inlet body 242 is elbow-shaped. This elbow shape facilitates redirection of the exhaust gas.

The outlet body 128 is configured to facilitate mixing of the exhaust gas, provided from the exhaust gas inlet body 242 to the outlet body opening 132, with the air, provided by the air inlet body 124. The outlet body wall 134 is configured to facilitate mixing of the air and the exhaust gas within the outlet body. The outlet body wall 134 is also configured to facilitate flow of the air from the air inlet body 124 into the exhaust gas inlet body 242.

The intake manifold assembly 103 also includes a seal member 244 (e.g., O-ring, etc.), as shown in FIG. 13. The seal member 244 is disposed between the exhaust gas inlet body 242 and the venturi body 170. The seal member 244 is configured to cooperate with the exhaust gas inlet body 242 and the venturi body 170 to establish a seal (e.g., exhaust gas-tight seal, etc.) between the exhaust gas inlet body 242 and the venturi body 170. In various embodiments, the seal member 244 is a radial seal member.

Figure 15:
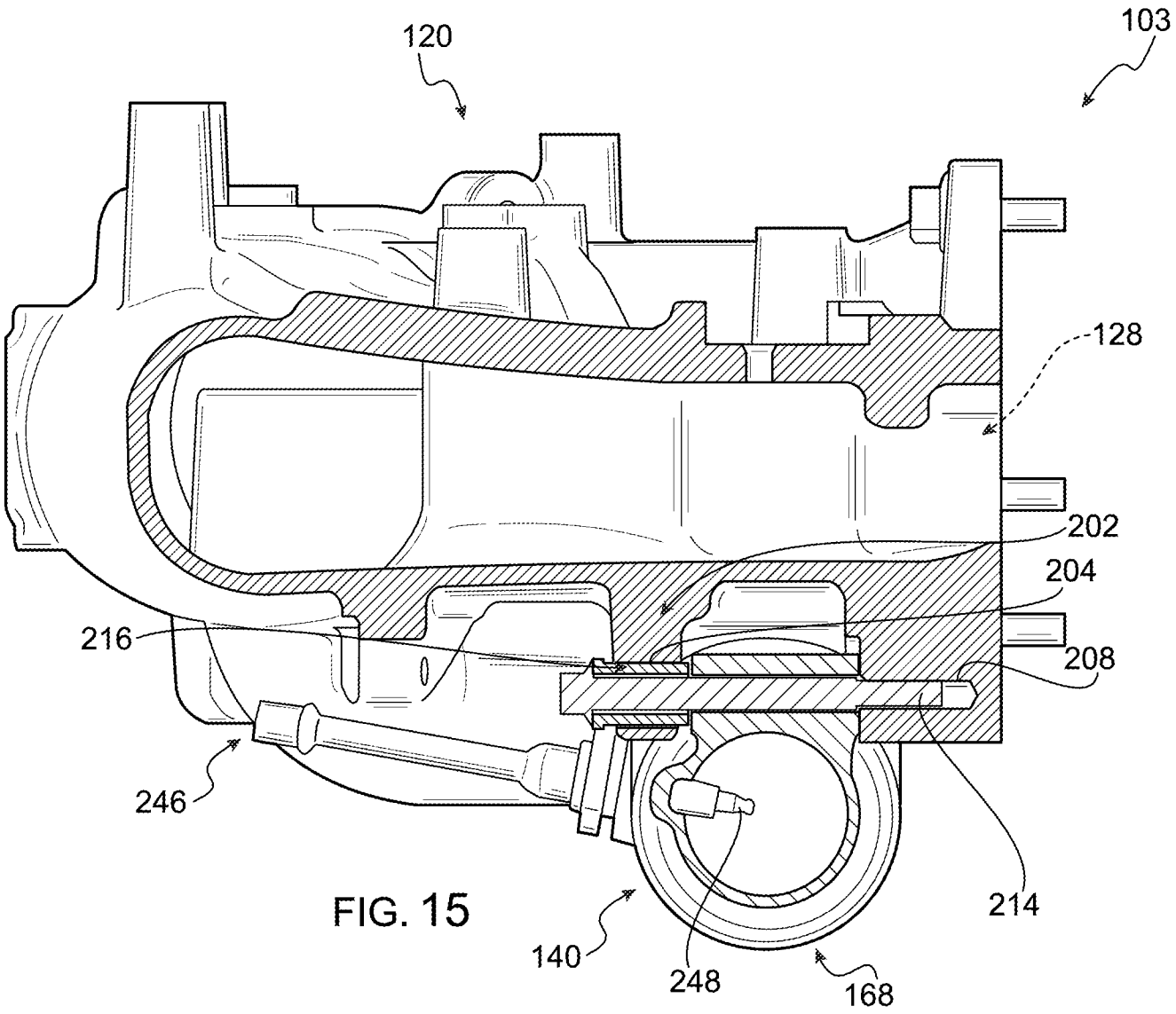
FIG. 15 is a cross-sectional view of the intake manifold assembly shown in FIG. 13 taken along plane E-E.
Figure 16:
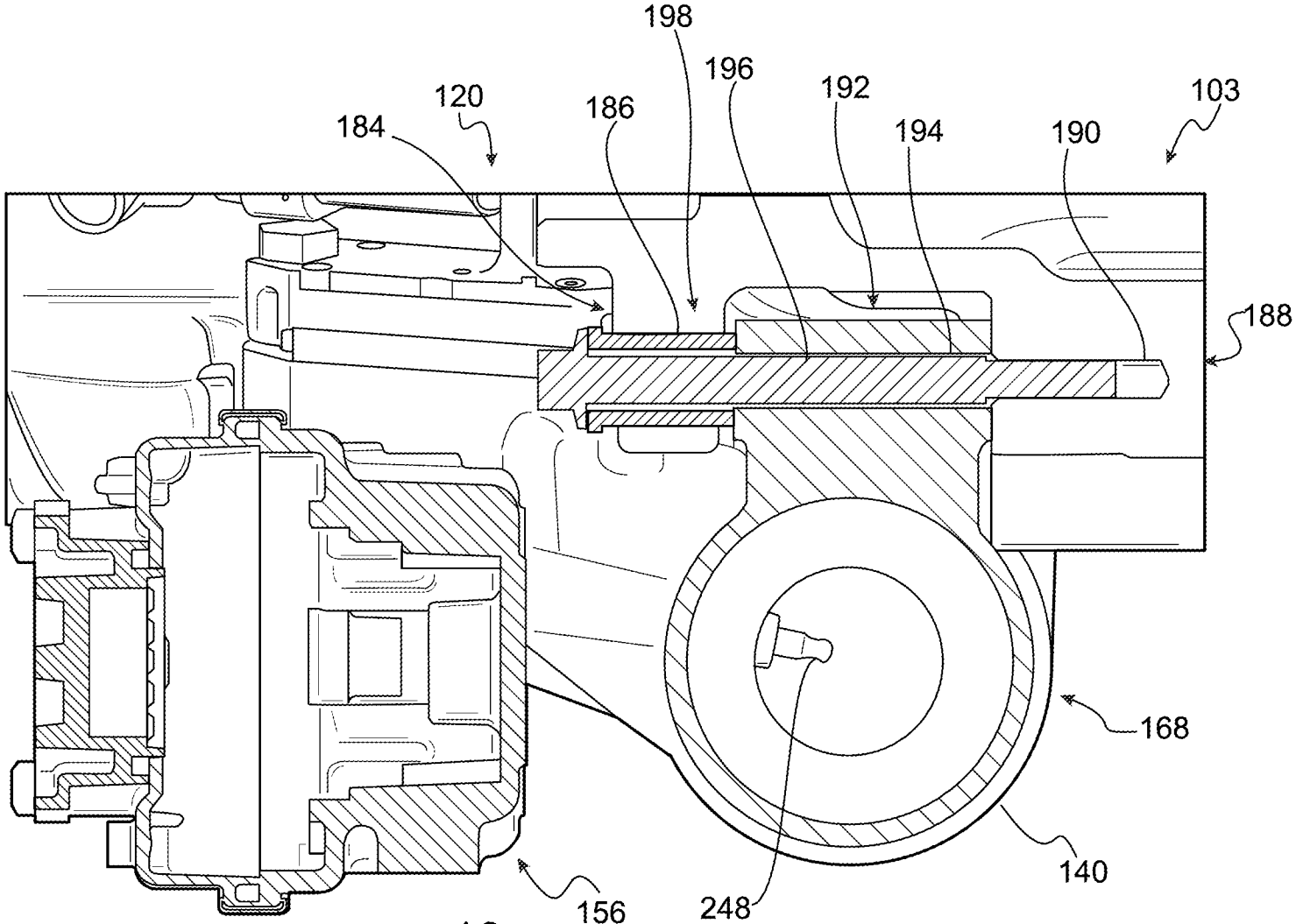
FIG. 16 is a cross-sectional view of the intake manifold assembly shown in FIG. 13 taken along plane F-F.
Figure 17:
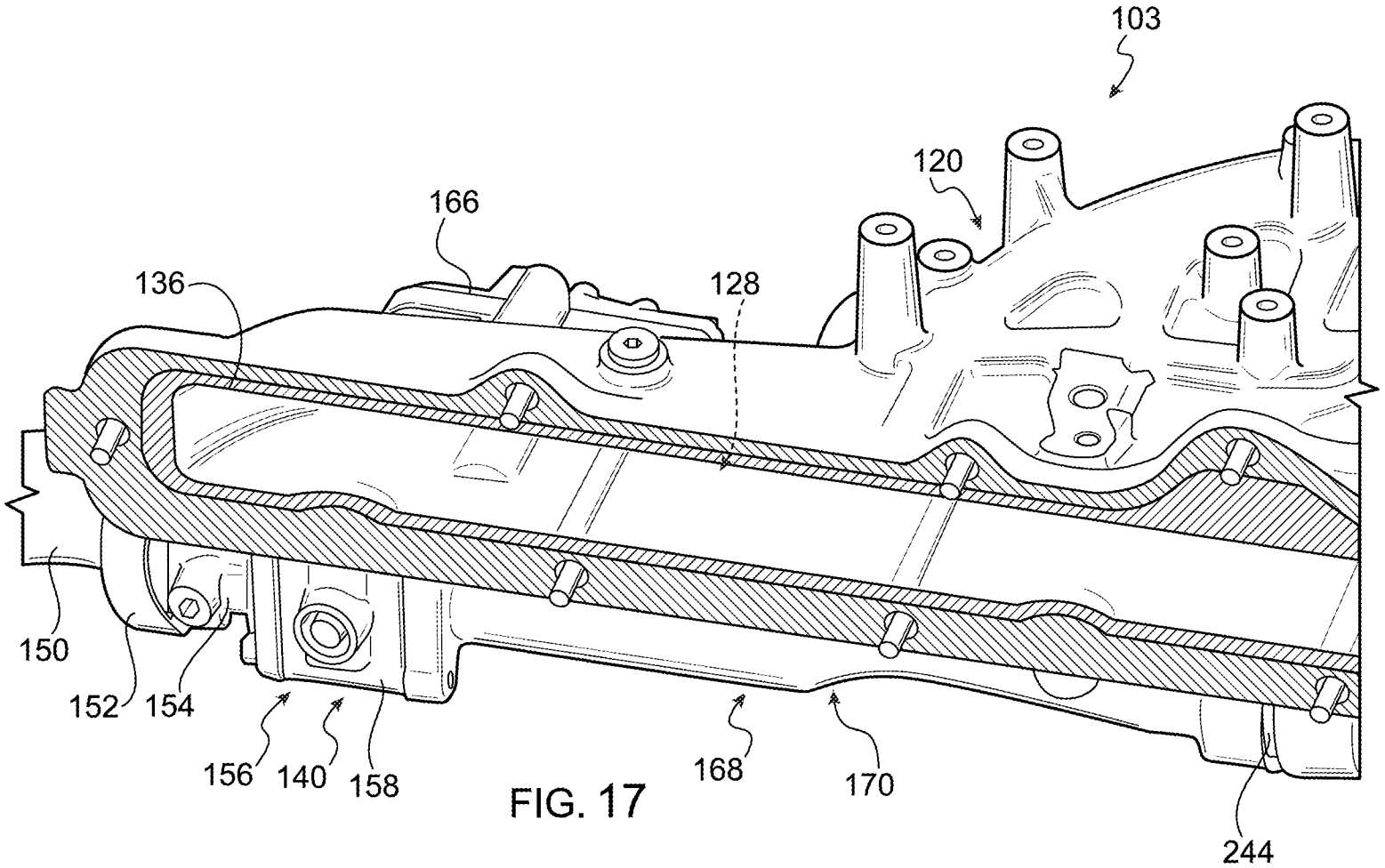
FIG. 17 is a rear view of a portion of the intake manifold assembly shown in FIG. 12.
Figure 18:
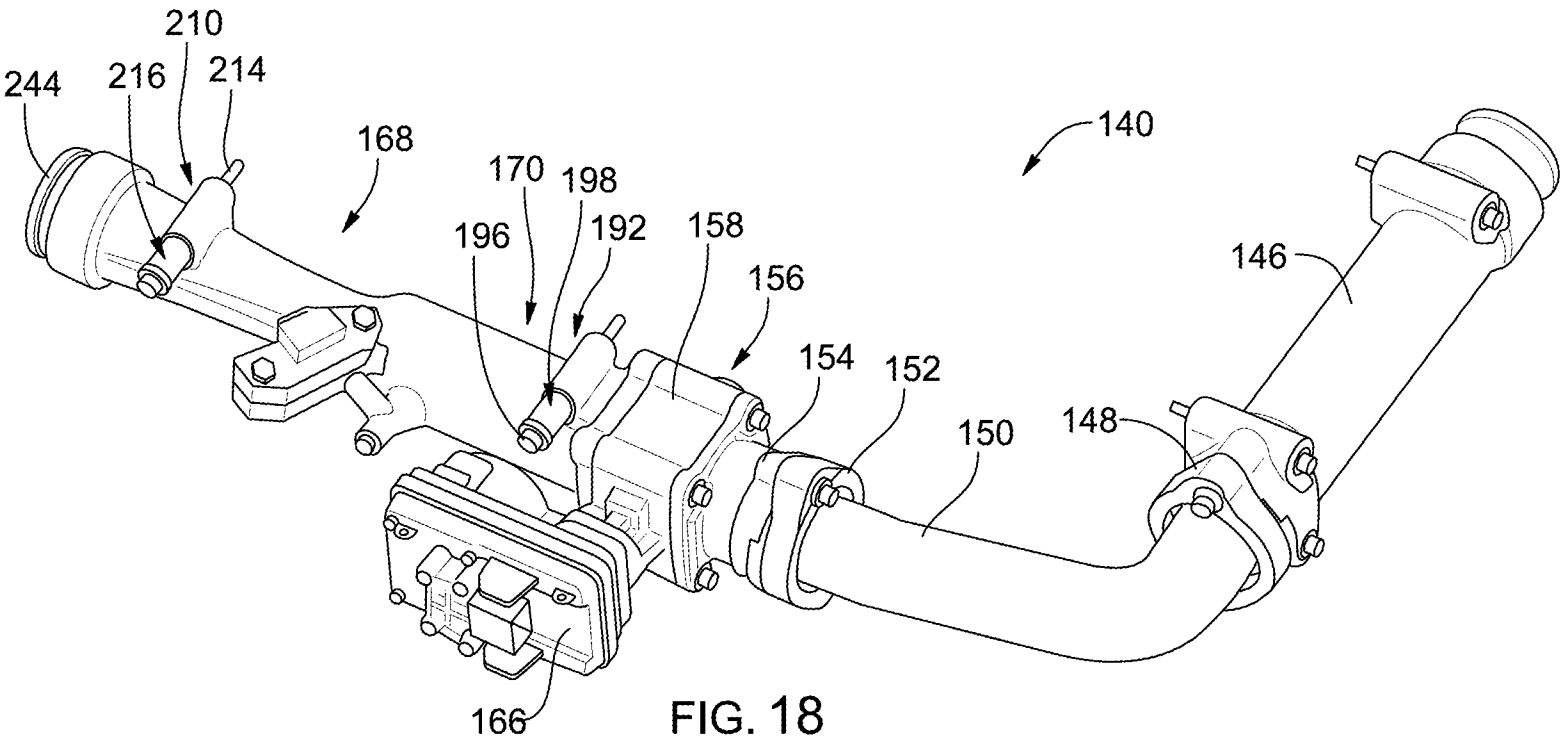
FIG. 18 is a perspective view of a portion of the intake manifold assembly of FIG. 1.
Figure 19:
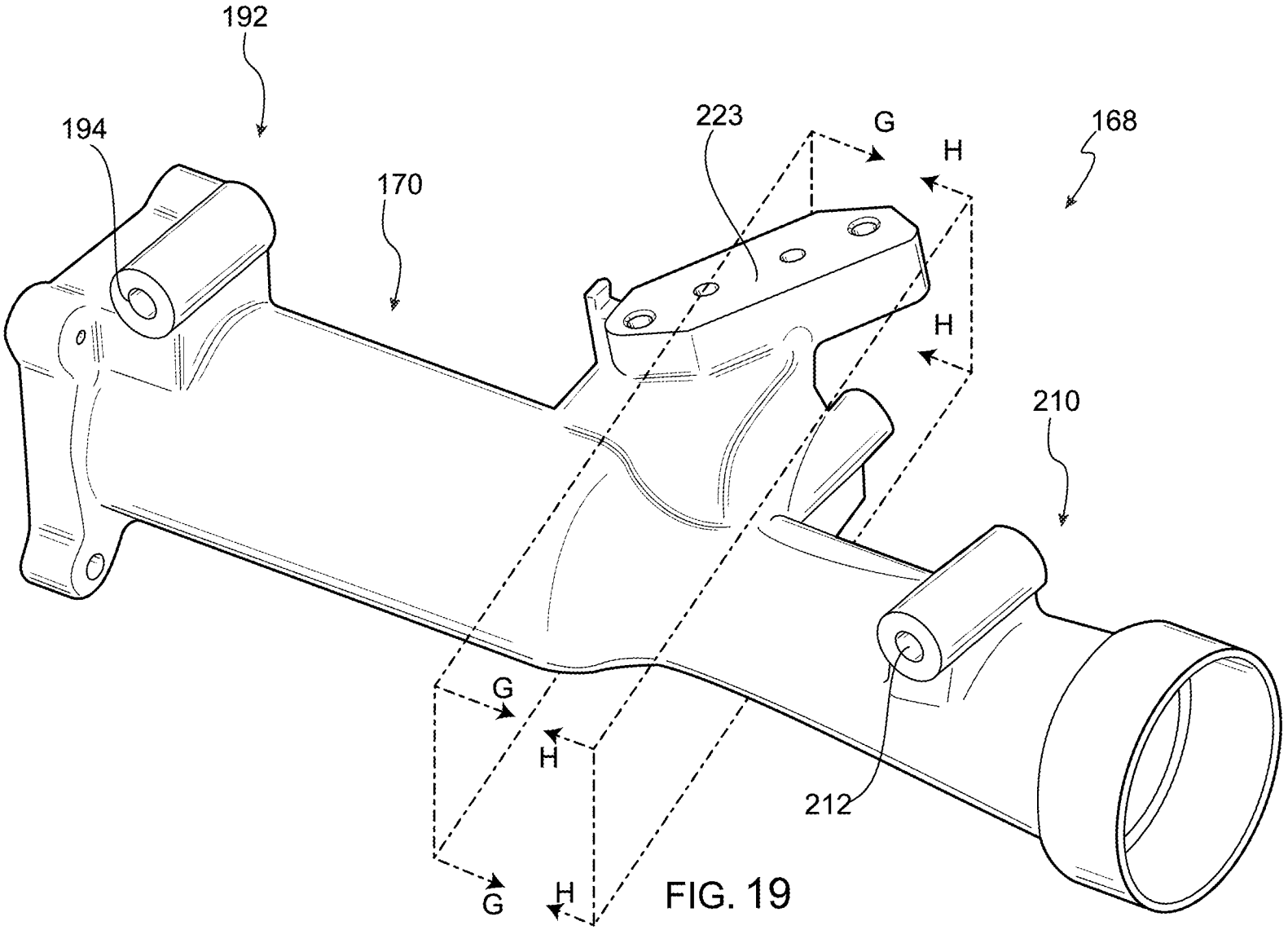
FIG. 19 is a perspective view of a venturi of the intake manifold assembly of FIG. 1.

As shown in FIG. 15, the intake manifold assembly 103 also includes a temperature sensor assembly 246 (e.g., exhaust gas temperature sensor assembly, etc.). The temperature sensor assembly 246 is configured to facilitate measurement of a temperature of the exhaust gas within the exhaust gas inlet body 242. The temperature sensor assembly 246 includes a probe 248 (e.g., sensor tip, pipe, etc.). The probe 248 is centered on an axis that is angularly separated from a horizontal axis (that is orthogonal to the venturi center axis 174) by an angular separation. In various embodiments, the angular separation is approximately equal to 10°. The angular separation may facilitate drainage of condensation from the probe 248.

In some embodiments, the intake manifold 120 is integrally formed via additive manufacturing. For example, the intake manifold 120 may be integrally formed using 3D printing, selective laser sintering, selective laser melting (SLM), direct metal laser sintering (DMLS), electron beam melting (EBM), ultrasonic additive manufacturing (UAM), fused deposition modeling (FDM), fused filament fabrication (FFF), stereolithography (SLA), material jetting, binder jetting or other similar processes. As explained above, the air inlet body 124, the outlet body 128, and the exhaust gas inlet body 242 are formed and joined together as part of a single manufacturing step (e.g., 3D printing, selective laser sintering, SLM, DMLS, EBM, UAM, FDM, FFF, SLA, material jetting, binder jetting, etc.) to a create a single-piece or unitary construction, the air inlet body 124, the outlet body 128, and the exhaust gas inlet body 242, that cannot be disassembled without an at least partial destruction of the air inlet body 124, the outlet body 128, and the exhaust gas inlet body 242. For example, the portions of the air inlet body 124, the outlet body 128, and the exhaust gas inlet body 242 are: (i) not separable from each other (e.g., one portion of the air inlet body 124, the outlet body 128, and/or the exhaust gas inlet body 242 cannot be separated from the air inlet body 124, the outlet body 128, and/or the exhaust gas inlet body 242 without destroying the air inlet body 124, the outlet body 128, and the exhaust gas inlet body 242, etc.); (ii) not formed separately from each other (e.g., the portions of the air inlet body 124, the outlet body 128, and/or the exhaust gas inlet body 242 are formed simultaneously, the portions of the air inlet body 124, the outlet body 128, and/or the exhaust gas inlet body 242 are formed as a single component in a single process, etc.); and (iii) there are no gaps or joints along borders between contiguous portions of the air inlet body 124, the outlet body 128, and/or the exhaust gas inlet body 242 (e.g., portions that share a border, etc.).

It is understood that alternatively or in addition to coupling to the cylinder head 114, the various components of the intake manifold assembly 103 may be coupled to a cylinder block of the internal combustion engine system 100.

Figure 27:
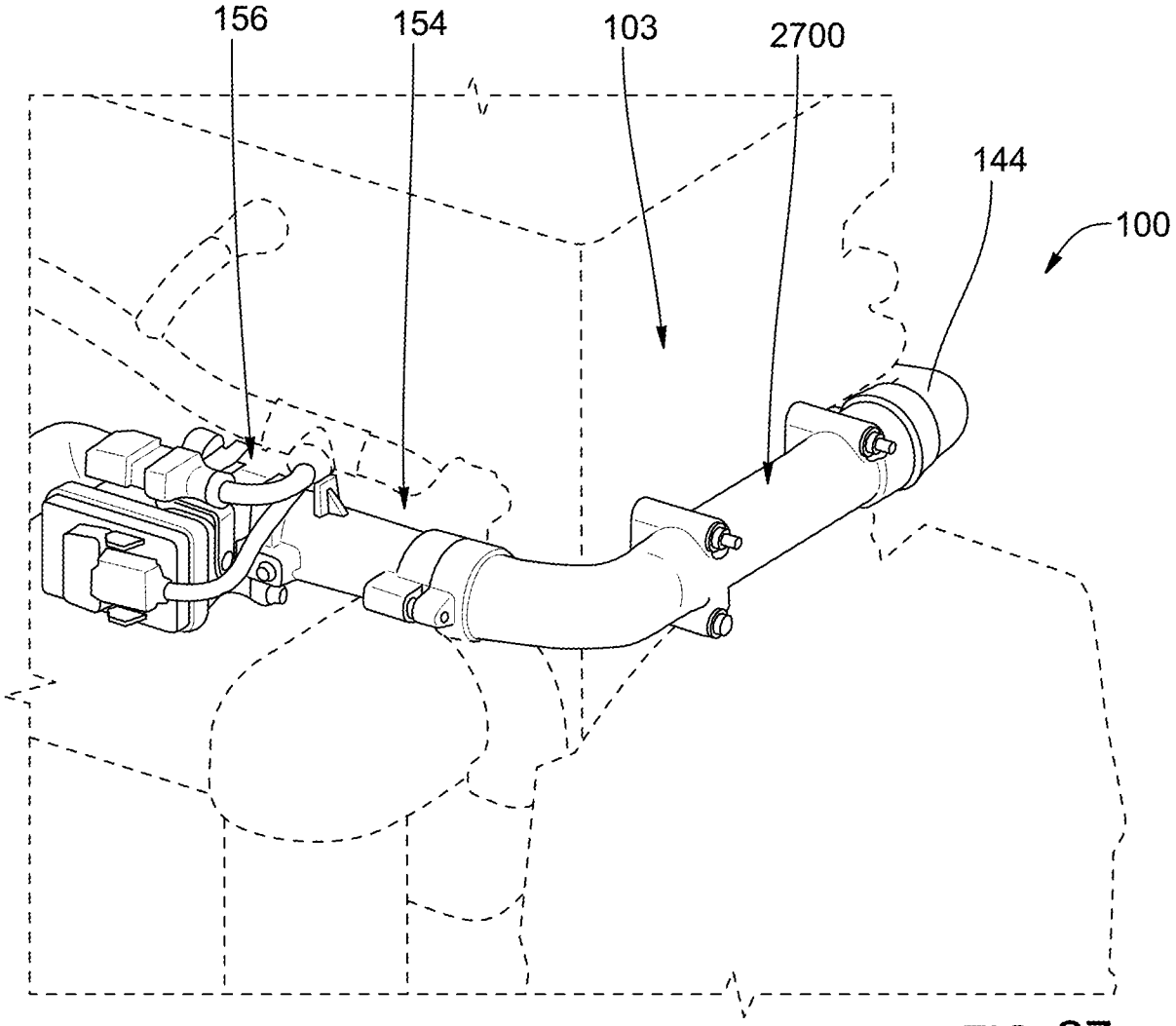
FIG. 27 is a perspective view of another internal combustion engine system.

FIGS. 27-43 depict the internal combustion engine system 100 according to other various embodiments. As shown in FIG. 27, the intake manifold assembly 103 includes an elbow pipe 2700 (e.g., transfer casting, etc.). The elbow pipe 2700 is coupled to the fluid heat exchanger 144 and is configured to receive the exhaust gas from the fluid heat exchanger 144. The elbow pipe 2700 functions as both the crossover pipe 150 and the transfer pipe 146 described herein. Thus, the elbow pipe 2700 eliminates the upstream seal joint 148 which enhances sealing of the exhaust gas within the intake manifold assembly 103. In various embodiments, the elbow pipe 2700 is cast from a metal, such as aluminum.

Figure 28:
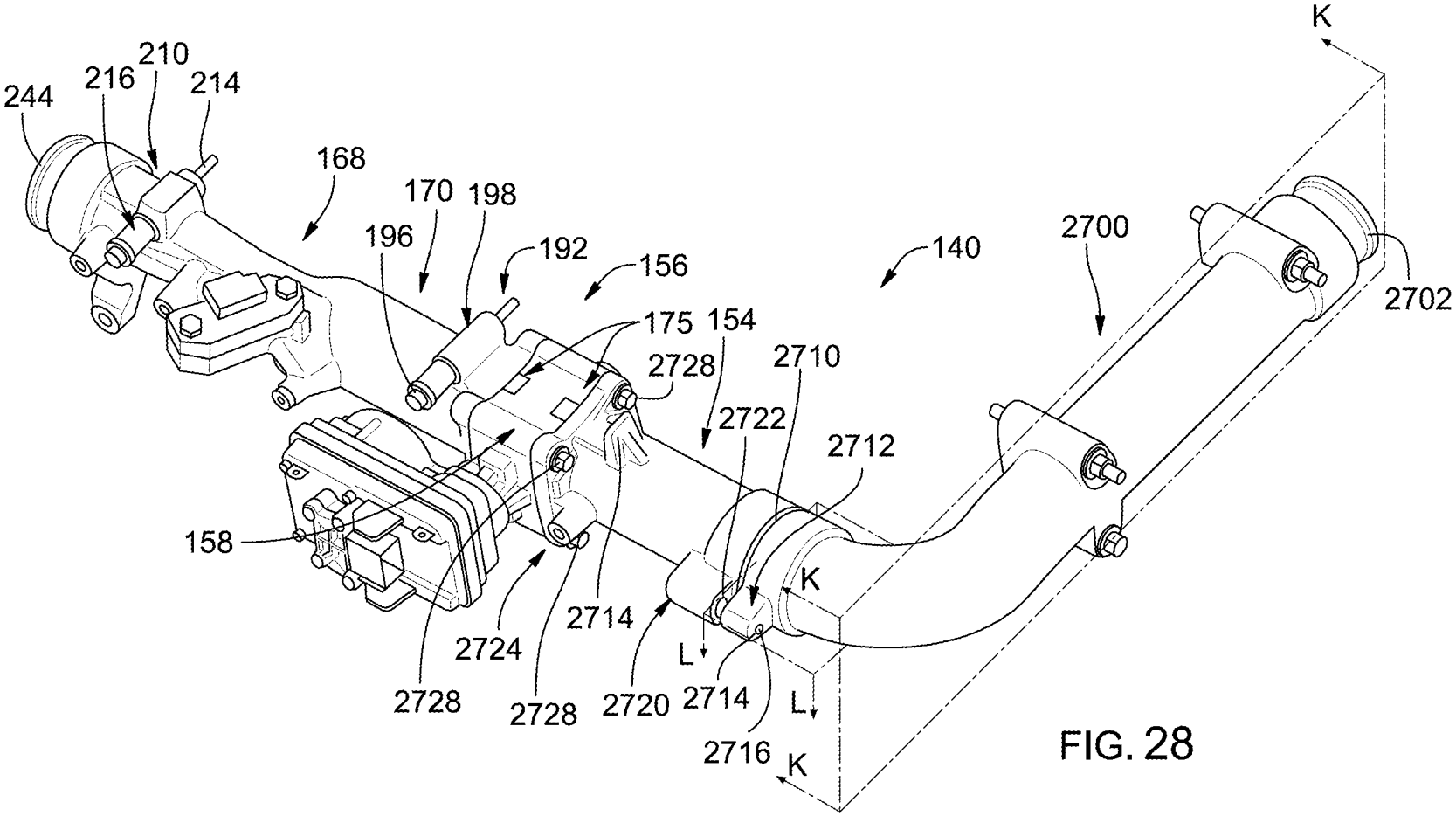
FIG. 28 is a perspective view of a portion of the intake manifold assembly of the internal combustion engine system shown in FIG. 27.

The intake manifold assembly 103 also includes an upstream elbow seal member 2702 (e.g., O-ring, etc.), as shown in FIG. 28. The upstream elbow seal member 2702 is disposed between the elbow pipe 2700 and the fluid heat exchanger 144. The upstream elbow seal member 2702 is configured to cooperate with the elbow pipe 2700 and the fluid heat exchanger 144 to establish a seal (e.g., exhaust gas-tight seal, etc.) between the elbow pipe 2700 and the fluid heat exchanger 144. In various embodiments, the upstream elbow seal member 2702 is a radial seal member.

Figure 29:
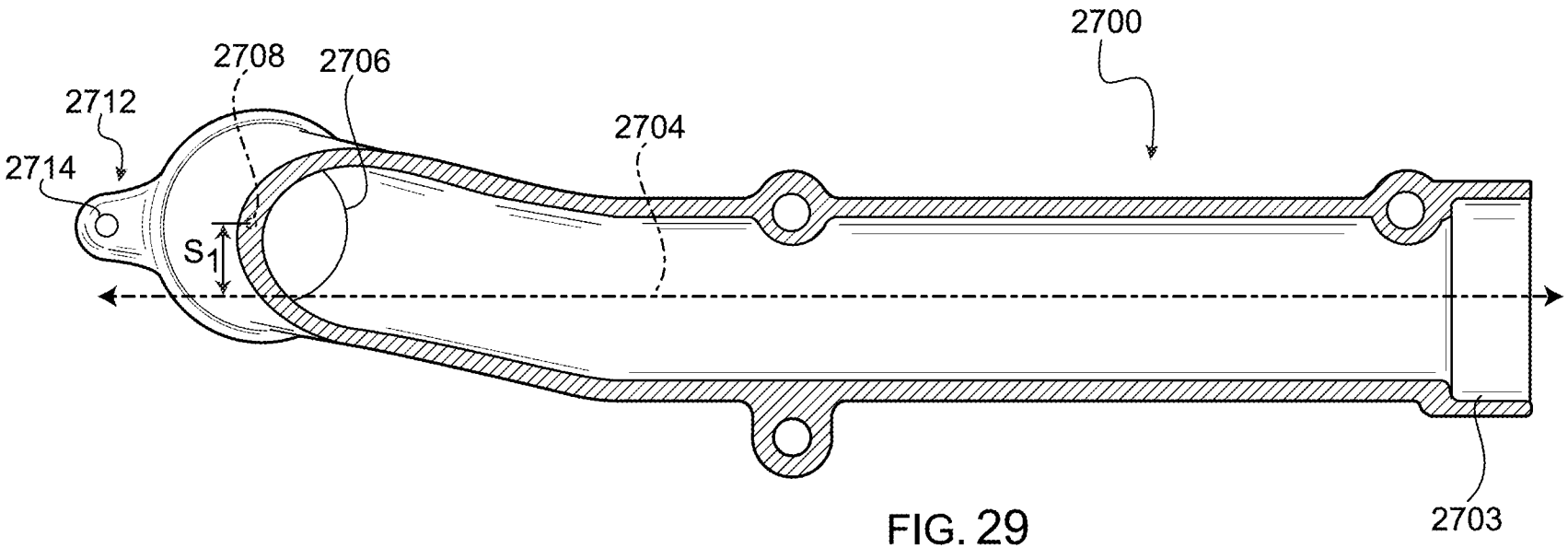
FIG. 29 is a cross-sectional view of the elbow pipe shown in FIG. 28 taken along plane K-K.
Figure 30:
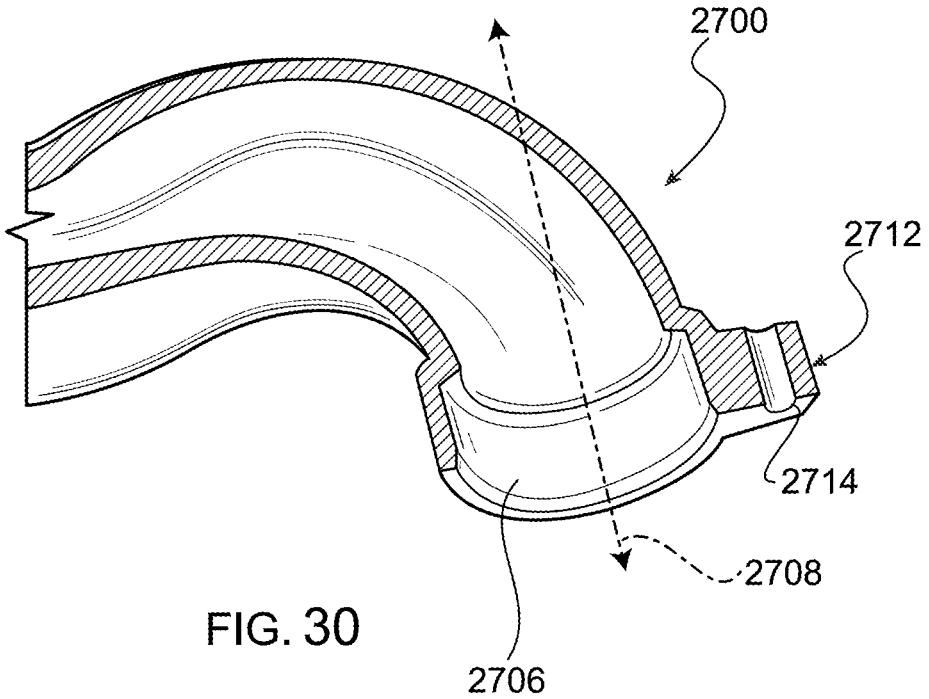
FIG. 30 is a cross-sectional view of a portion of the elbow pipe shown in FIG. 28 taken along plane L-L.

FIGS. 29 and 30 illustrate the elbow pipe 2700 in greater detail. The elbow pipe 2700 includes an elbow pipe inlet 2703 (e.g., inlet fitting, etc.). The elbow pipe inlet 2703 is configured to receive the upstream elbow seal member 2702. In some embodiments, the elbow pipe inlet 2703 has a diameter that is approximately equal to between 40 mm and 80 mm, inclusive. For example, the elbow pipe inlet 2703 may have a diameter that is approximately equal to 62 mm. In some embodiments, the elbow pipe inlet 2703 is coated with a coating, such as a green coating, that protects the elbow pipe 2700 against corrosion. The elbow pipe inlet 2703 is centered on an elbow pipe inlet axis 2704. As is explained in more detail herein, the elbow pipe 2700 is contoured such that a portion (e.g., upstream portion, etc.) of the elbow pipe 2700 is centered on the elbow pipe inlet axis 2704 and a portion (e.g., downstream portion, etc.) of the elbow pipe 2700 curved away from the elbow pipe inlet axis 2704 to redirect the exhaust gas away from the elbow pipe inlet axis 2704.

The elbow pipe 2700 also includes an elbow pipe outlet 2706 (e.g., outlet fitting, etc.). The elbow pipe outlet 2706 is configured to receive the seal member 244. In some embodiments, the elbow pipe outlet 2706 has a diameter that is approximately equal to between 40 mm and 80 mm, inclusive. For example, the elbow pipe outlet 2706 may have a diameter that is approximately equal to 62 mm. In some embodiments, the elbow pipe outlet 2706 is coated with a coating, such as a green coating, that protects the elbow pipe 2700 against corrosion.

The elbow pipe outlet 2706 is centered on an elbow pipe outlet axis 2708. The elbow pipe outlet axis 2708 does not intersect the elbow pipe inlet axis 2704. Instead, the elbow pipe 2700 curves around an elbow (e.g., corner, etc.) between the elbow pipe inlet 2703 and the elbow pipe outlet 2706 and also curved away from the elbow pipe inlet axis 2704 and towards the elbow pipe outlet axis 2708. As a result, the exhaust gas is both redirected around the corner and vertically towards the elbow pipe outlet 2706. Such an arrangement may be beneficial in accounting for packaging constraints on the intake manifold assembly 103. A separation $S_1$ between the elbow pipe inlet axis 2704 and the elbow pipe outlet axis 2708 may be measured along a plane along which the elbow pipe inlet axis 2704 extends, the elbow pipe outlet axis 2708 intersects, and the elbow pipe outlet axis 2708 is orthogonal to. In various embodiments, the elbow pipe 2700 is configured such that the separation Si is approximately equal to between 10 mm and 40 mm, inclusive. For example, the elbow pipe 2700 may be configured such that the separation $S_1$ is approximately equal to 23 mm.

In these embodiments, the intake manifold assembly 103 does not include the downstream seal joint 152. Instead, the intake manifold assembly 103 also includes an downstream elbow seal member 2710 (e.g., O-ring, etc.), as shown in FIG. 28. The downstream elbow seal member 2710 is disposed between the elbow pipe 2700 and the EGR adaptor 154. The downstream elbow seal member 2710 is configured to cooperate with the elbow pipe 2700 and the EGR adaptor 154 to establish a seal (e.g., exhaust gas-tight seal, etc.) between the elbow pipe 2700 and the EGR adaptor 154. In various embodiments, the downstream elbow seal member 2710 is a radial seal member.

The elbow pipe 2700 also includes an elbow pipe outlet flange 2712 (e.g., rib, protrusion, etc.). The elbow pipe outlet flange 2712 is disposed proximate the elbow pipe outlet 2706 and is configured to facilitate coupling between the elbow pipe 2700 and the EGR adaptor 154. The elbow pipe outlet flange 2712 includes an elbow pipe aperture 2714 (e.g., bore, etc.). As is explained in more detail herein, the elbow pipe aperture 2714 is configured to receive an elbow pipe fastener 2716 (e.g., cap screw, etc.) which couples the elbow pipe 2700 and the EGR adaptor 154. In some embodiments, the elbow pipe aperture 2714 is threaded and is configured to threadably engage the elbow pipe fastener 2716.

Figure 31:
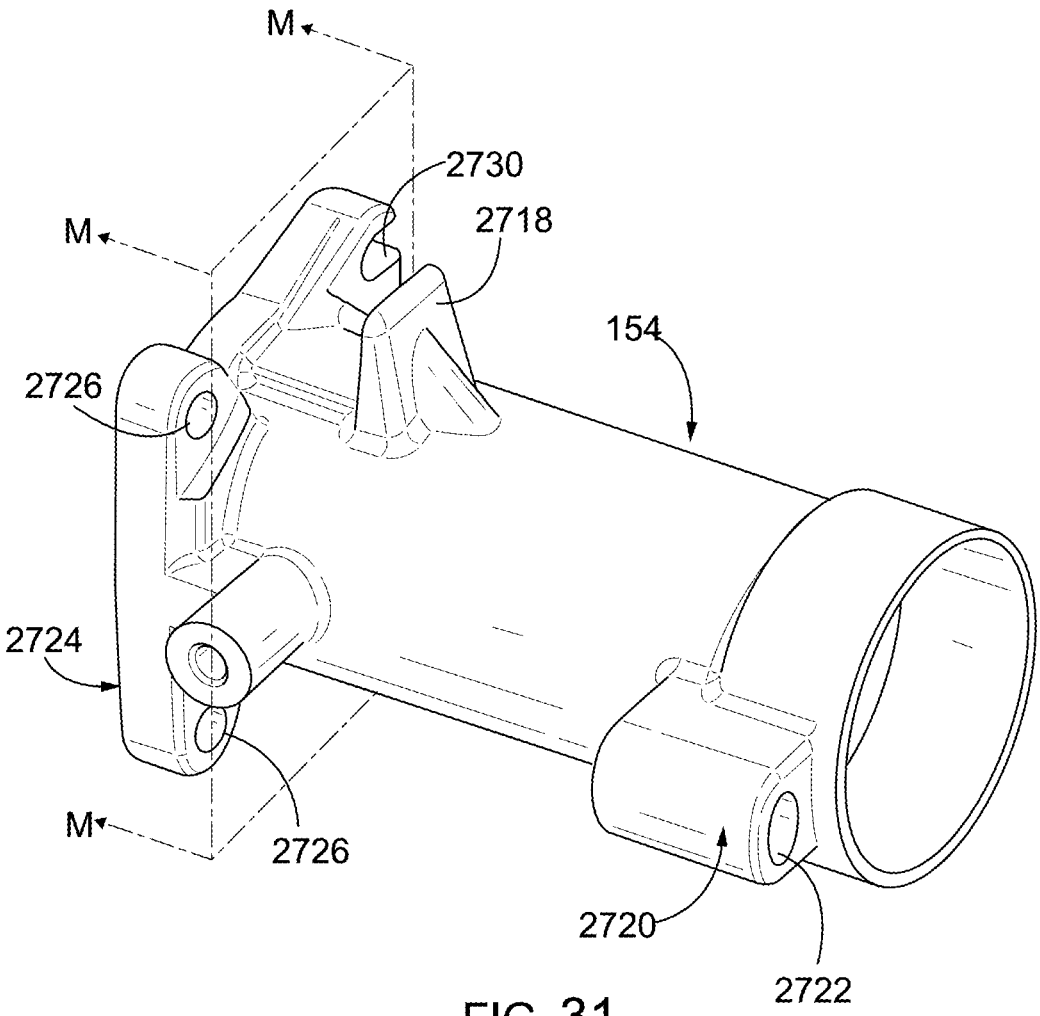
FIG. 31 is a perspective view of an EGR adaptor of the internal combustion engine system of FIG. 27.

The EGR adaptor 154 in these embodiments differs in certain respects from the EGR adaptor 154 utilized in the intake manifold assembly 103 described in FIGS. 1-26. Specifically, as shown in FIG. 31, the EGR adaptor 154 is elongated, configured to receive the downstream elbow seal member 270, and includes a pry bar 2718 (e.g., rib, flange, etc.). The pry bar 2718 is configured to facilitate interaction of a tool (e.g., screwdriver, etc.) with the EGR adaptor 154 so that a user can bias the EGR adaptor 154 towards the elbow pipe 2700 to compress the downstream elbow seal member 2710 between the EGR adaptor 154 and the elbow pipe 2700.

Figure 33:
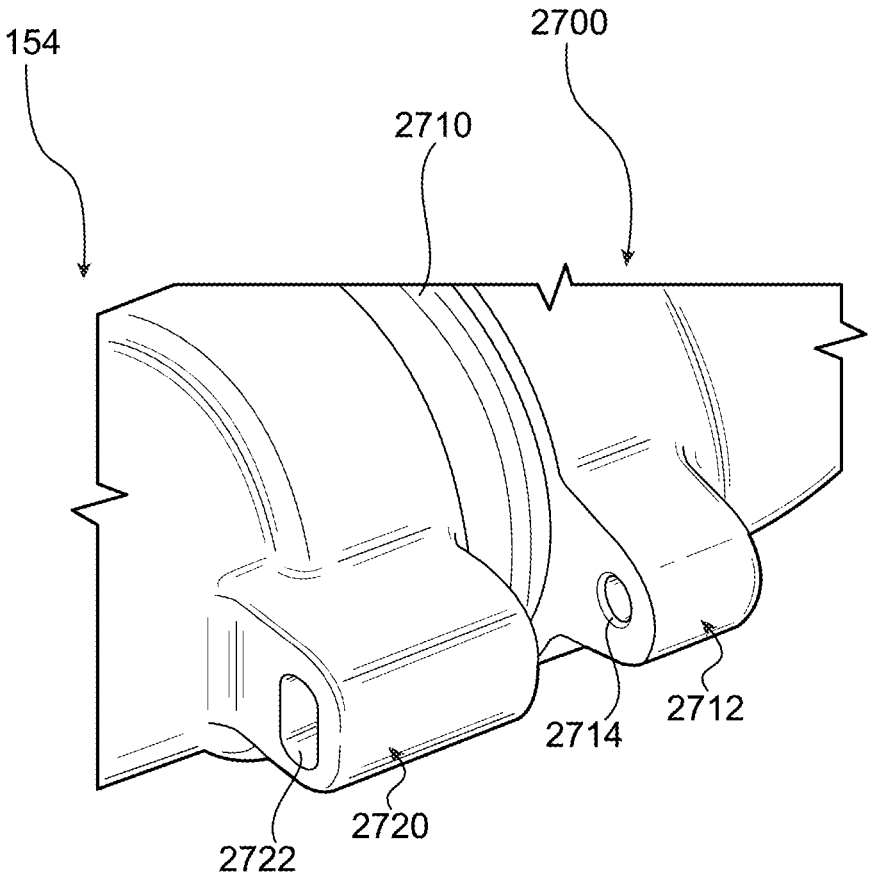
FIG. 33 is another perspective view of a portion of the intake manifold assembly shown in FIG. 27.
Figure 34:
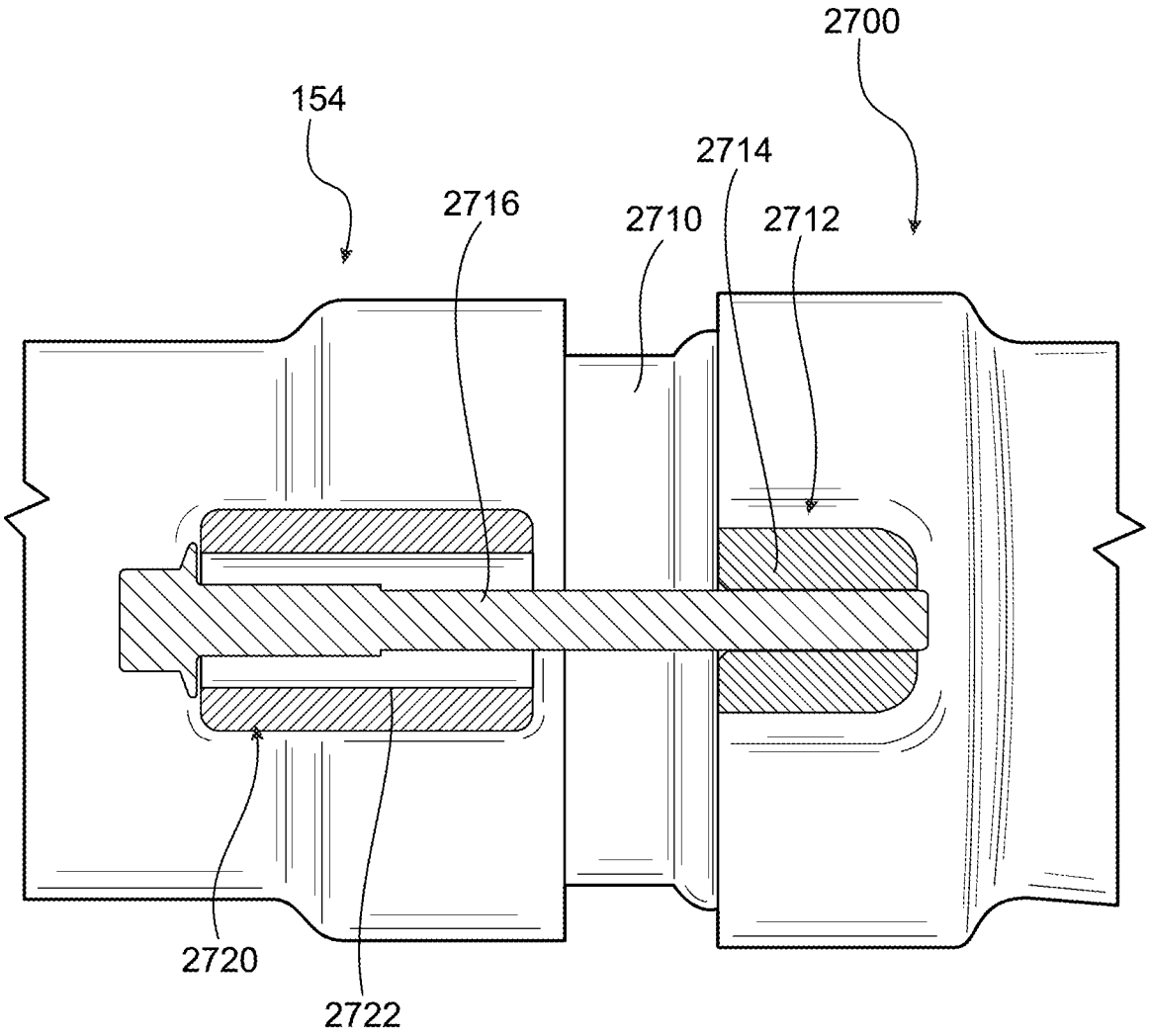
FIG. 34 is another perspective view of a portion of the intake manifold assembly shown in FIG. 27.
Figure 35:
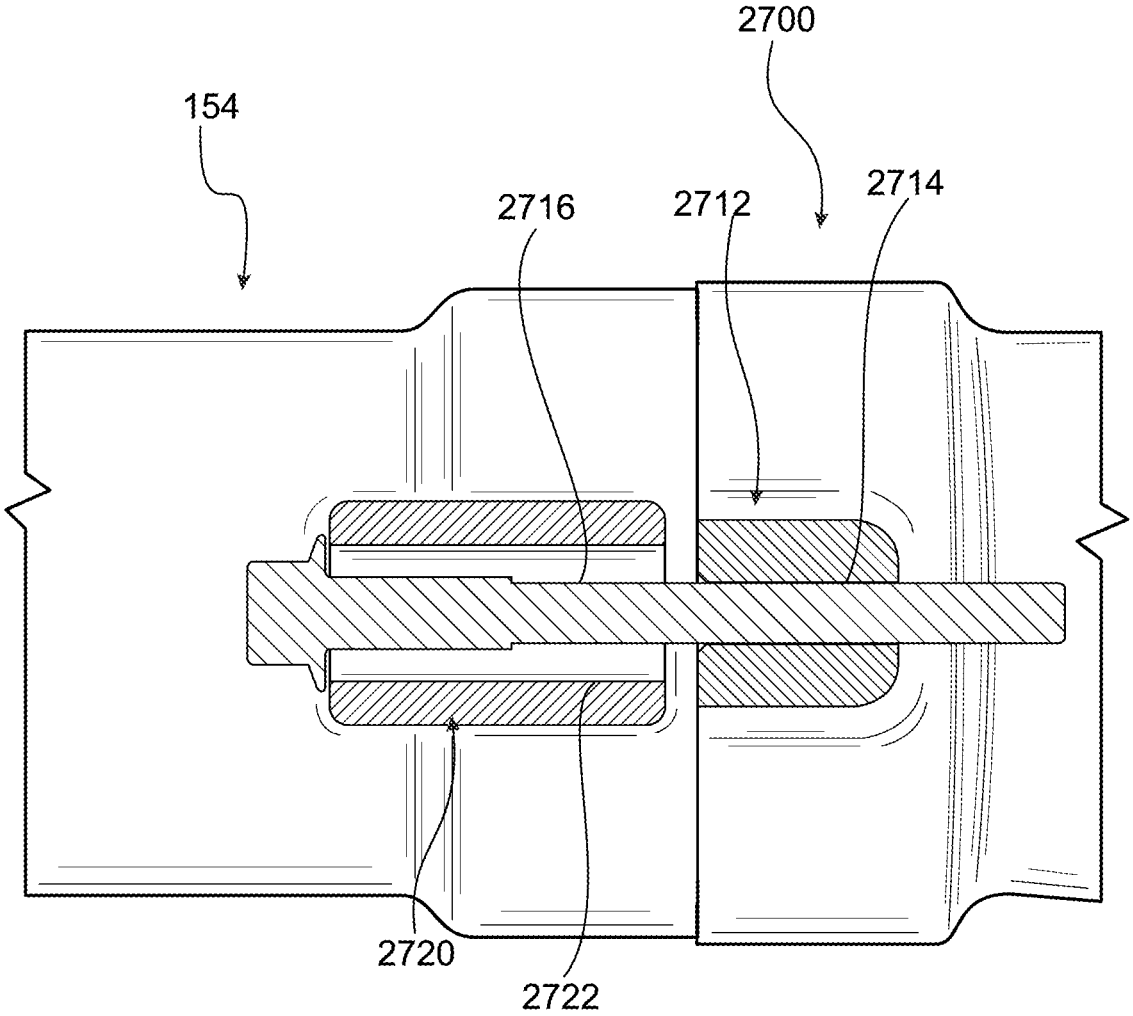
FIG. 35 is another perspective view of a portion of the intake manifold assembly shown in FIG. 27.

Similar to the elbow pipe 2700, the EGR adaptor 154 also includes an EGR adaptor inlet flange 2720 (e.g., rib, protrusion, etc.), as shown in FIGS. 33-35. The EGR adaptor inlet flange 2720 is disposed proximate an inlet of the EGR adaptor 154 and is configured to facilitate coupling between the elbow pipe 2700 and the EGR adaptor 154. The EGR adaptor inlet flange 2720 includes an EGR adaptor inlet flange aperture 2722 (e.g., bore, etc.). As is explained in more detail herein, the EGR adaptor inlet flange aperture 2722 is configured to receive the elbow pipe fastener 2716 which couples the elbow pipe 2700 and the EGR adaptor 154. In some embodiments, the EGR adaptor inlet flange aperture 2722 is threaded and is configured to threadably engage the elbow pipe fastener 2716.

The EGR adaptor 154 also includes an EGR adaptor outlet flange 2724 (e.g., rib, protrusion, etc.). The EGR adaptor outlet flange 2724 is disposed proximate an outlet of the EGR adaptor 154 and is configured to facilitate coupling between the EGR adaptor 154, the venturi 168, and the EGR throttle 156 such that the EGR throttle 156 can be decoupled from the EGR adaptor 154 and the venturi 168 while the EGR adaptor 154 remains coupled to the venturi.

Figure 32:
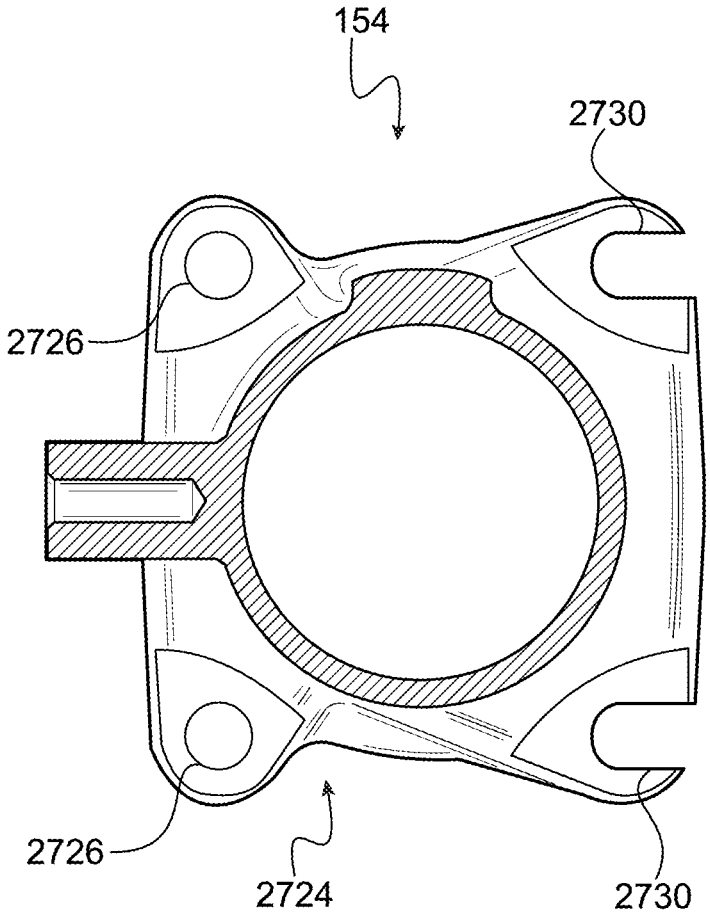
FIG. 32 is a cross-sectional view of the EGR adaptor shown in FIG. 31 taken along plane M-M.

As shown in FIGS. 31 and 32, the EGR adaptor outlet flange 2724 includes one or more EGR adaptor outlet flange apertures 2726 (e.g., bore, etc.). As is explained in more detail herein, the EGR adaptor outlet flange apertures 2726 are each configured to receive an EGR adaptor fastener 2728. In some embodiments, at least one of the EGR adaptor outlet flange apertures 2726 is threaded and is configured to threadably engage one of the EGR adaptor fasteners 2728. The EGR adaptor outlet flange 2724 also includes one or more EGR adaptor outlet flange slots 2730 (e.g., channels, etc.). As is explained in more detail herein, the EGR adaptor outlet flange slots 2730 are each configured to receive one of the EGR adaptor fasteners 2728.

Figure 36:
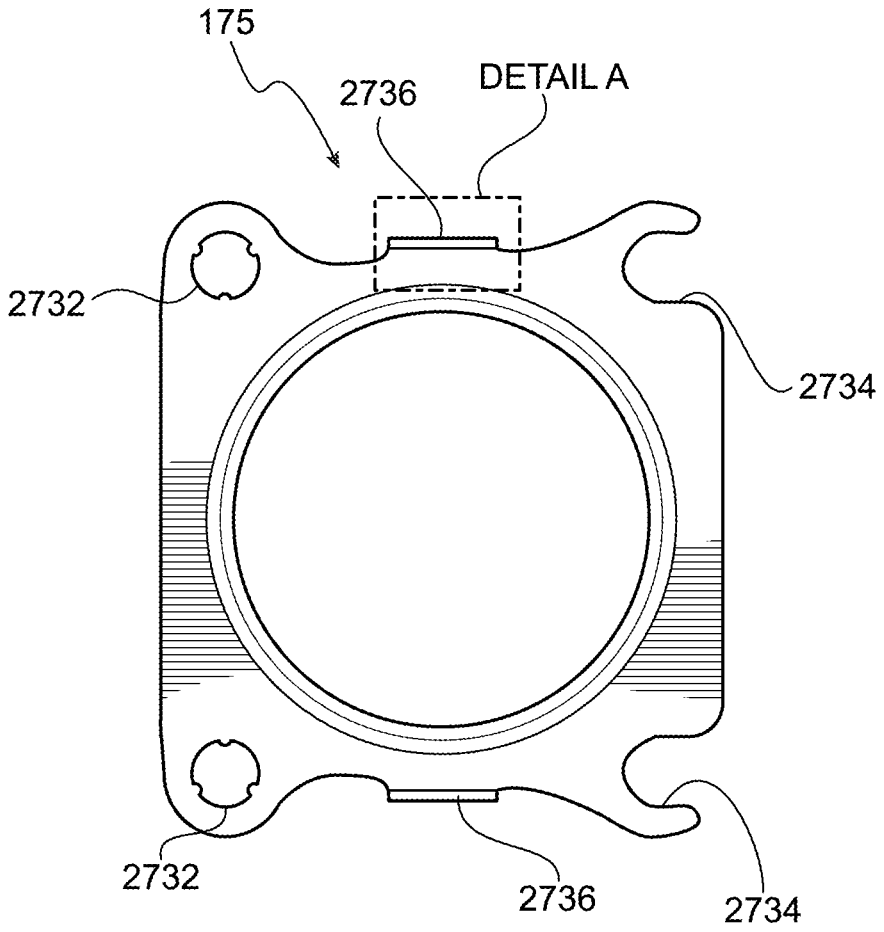
FIG. 36 is front view of an EGR gasket shown in FIG. 27.
Figure 37:
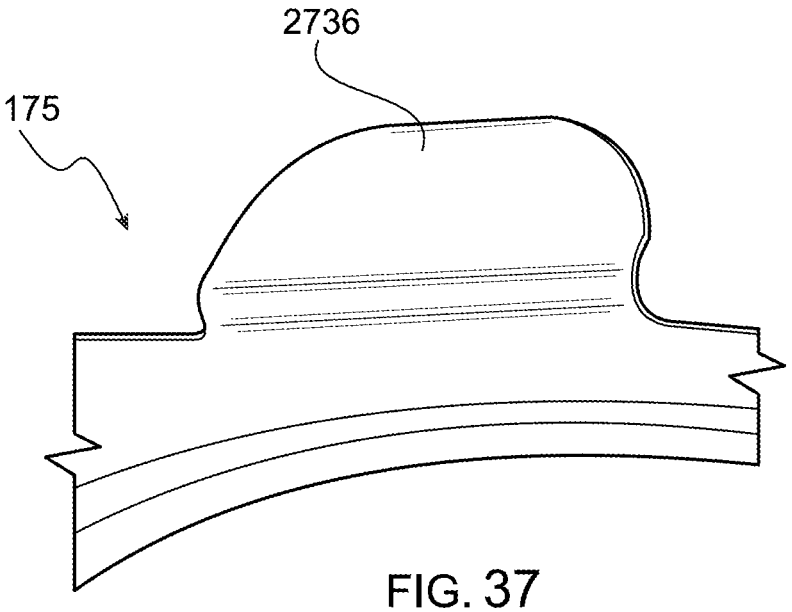
FIG. 37 is a detailed view of DETAIL A in FIG. 36.

In these embodiments, the EGR gasket 175 includes one or more EGR gasket apertures 2732 (e.g., bore, etc.), as shown in FIG. 36. As is explained in more detail herein, the EGR gasket apertures 2732 are each configured to receive one of the EGR adaptor fasteners 2728. The EGR gasket 175 also includes one or more EGR gasket slots 2734 (e.g., channels, etc.). As is explained in more detail herein, the EGR gasket slots 2734 are each configured to receive one of the EGR adaptor fasteners 2728. The EGR gasket 175 also includes at least one EGR gasket tab 2736 (e.g., tongue, etc.), as shown in FIG. 37. As is explained in more details here, the EGR gasket tabs 2736 assist in assembly of the intake manifold assembly 103.

Figure 38:
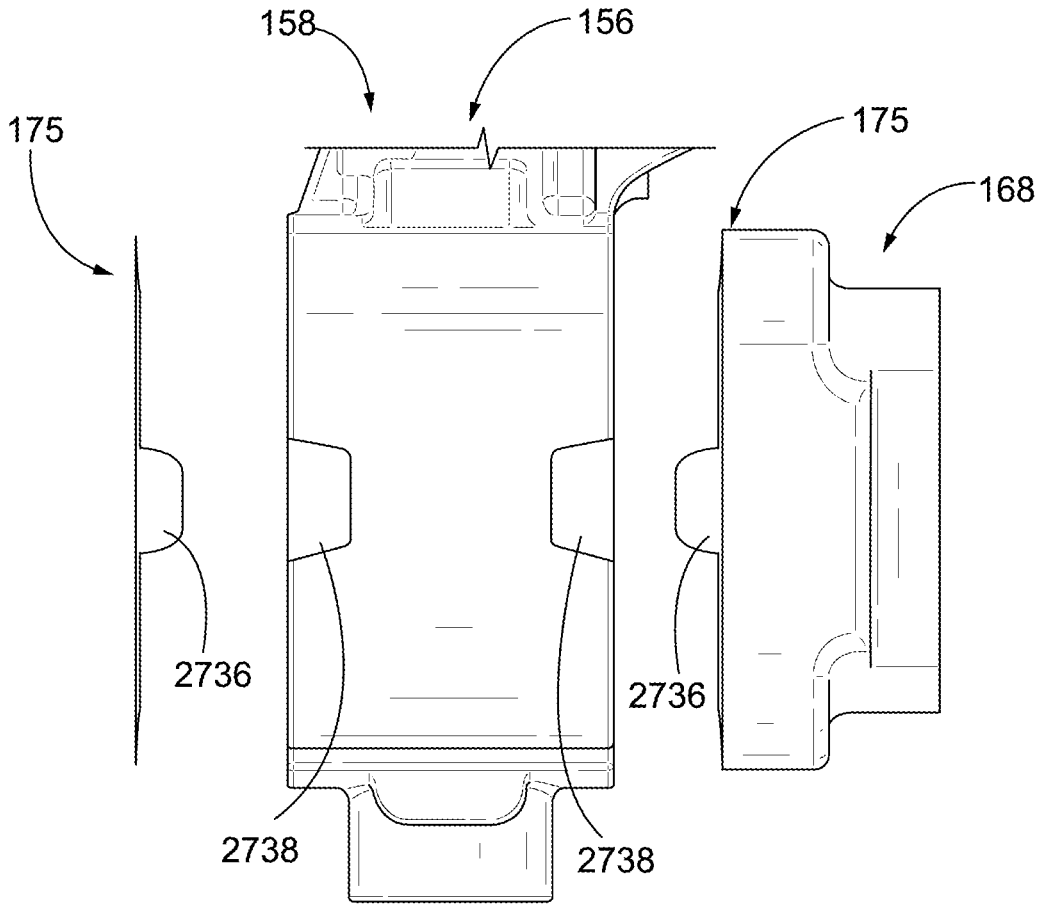
FIG. 38 is a partially-exploded view of a portion of the intake manifold assembly shown in FIG. 27.
Figure 39:
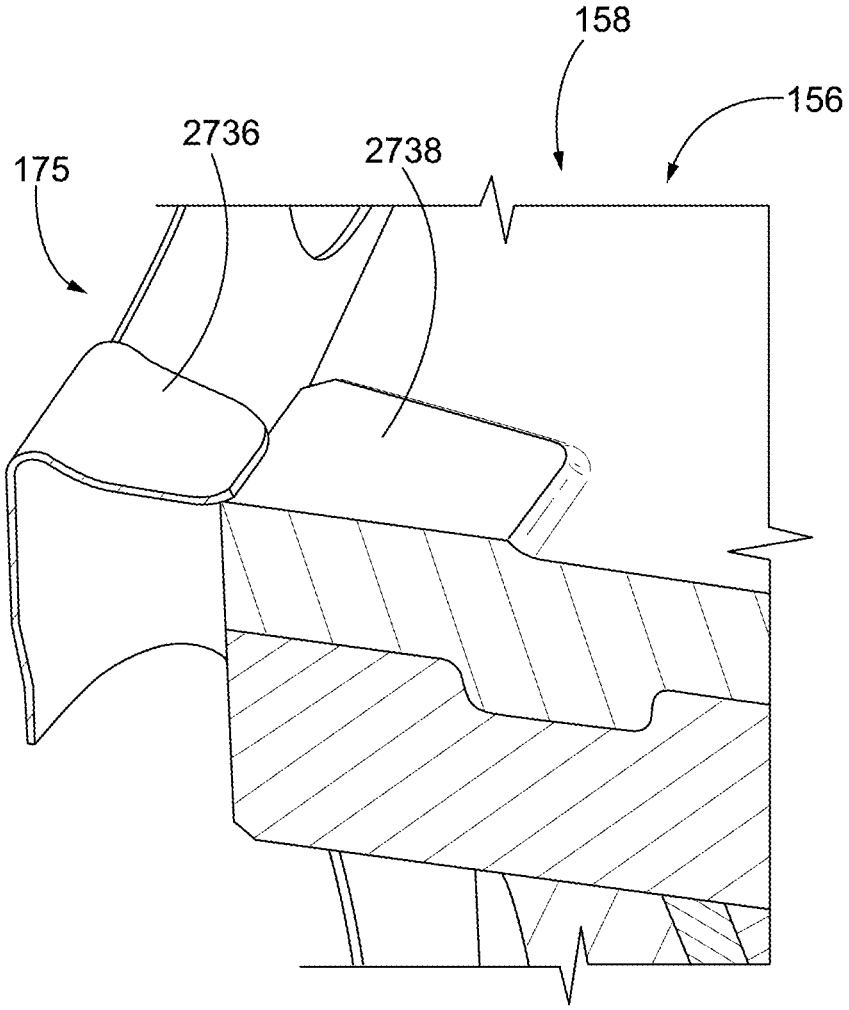
FIG. 39 is another partially-exploded view of a portion of the intake manifold assembly shown in FIG. 27.

One of the EGR gaskets 175 is inserted between the EGR adaptor 154 and the EGR throttle 156 and one of the EGR gaskets 175 is inserted between the EGR throttle 156 and the venturi 168, as shown in FIG. 28. As shown in FIG. 38, the EGR throttle body 158 includes a plurality of bosses 2738 (e.g., platforms, etc.). Each of the bosses 2738 interfaces with one of the EGR gasket tabs 2736, as shown in FIG. 39. An interaction between the EGR gasket tab 2736 and the boss 2738 functions to retain the EGR gaskets 175 on the EGR throttle 156.

Figure 40:
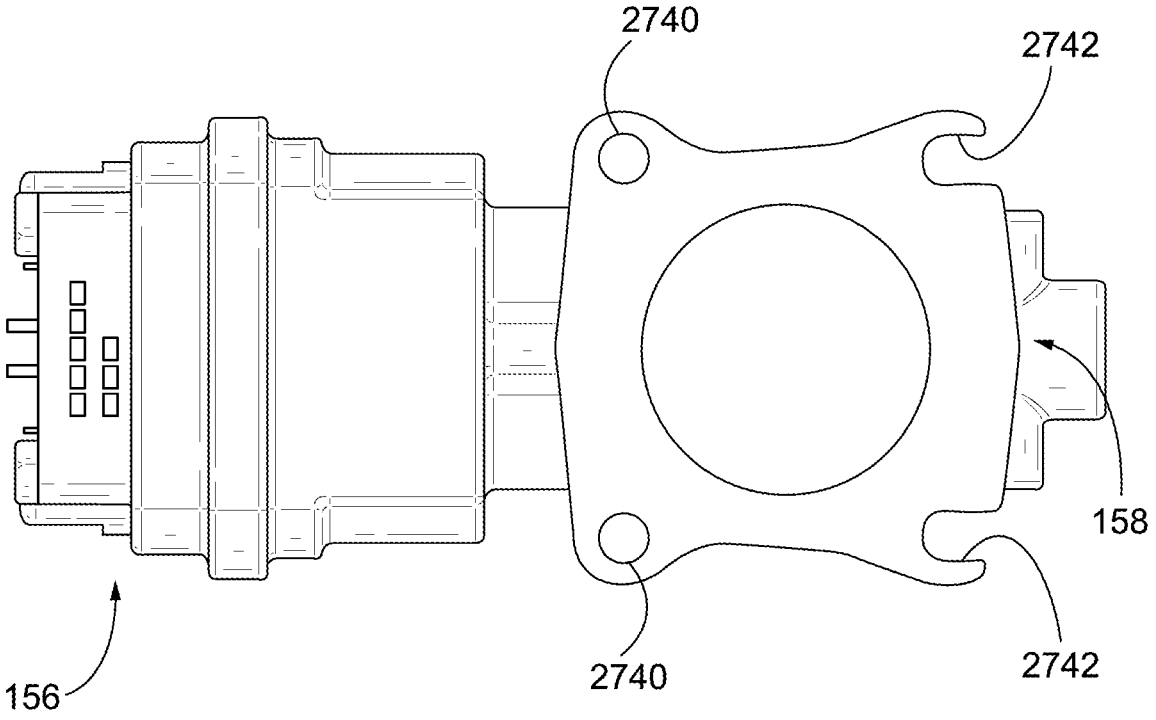
FIG. 40 is front view of an EGR throttle shown in FIG. 27.
Figure 41:
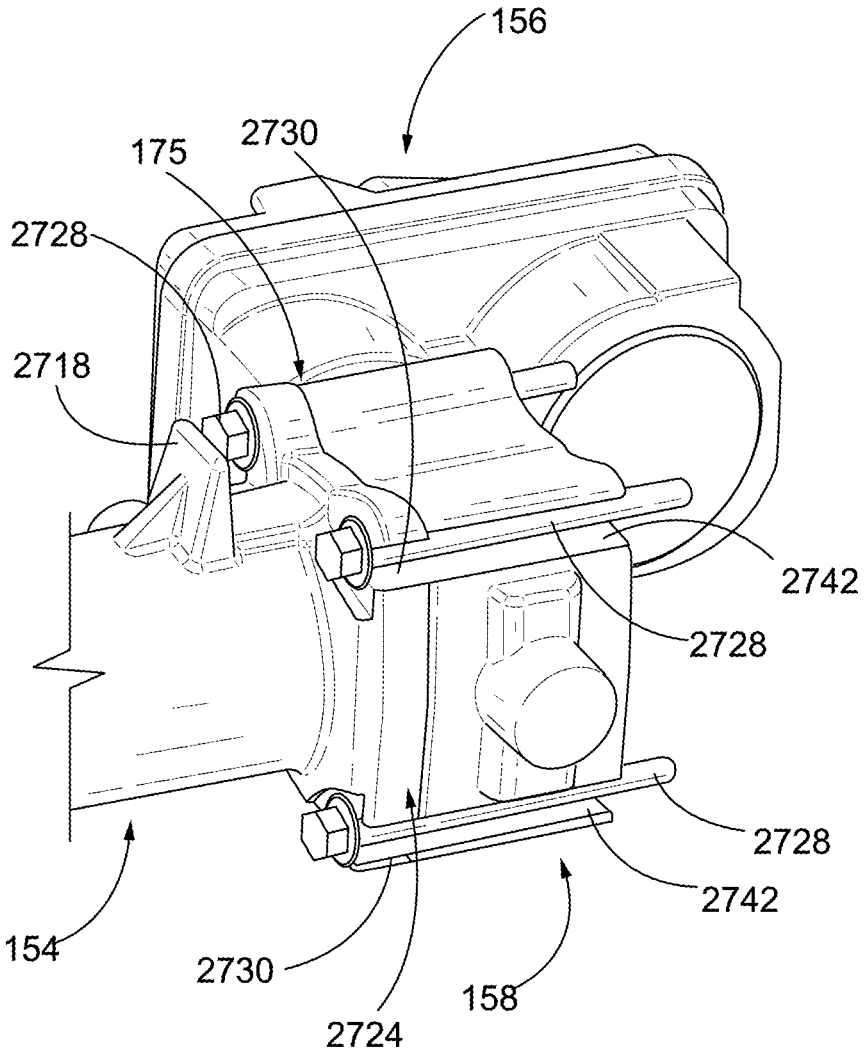
FIG. 41 is another perspective view of a portion of the intake manifold assembly shown in FIG. 27.

As shown in FIGS. 40 and 41, the EGR throttle body 158 includes one or more EGR throttle apertures 2740 (e.g., bore, etc.). As is explained in more detail herein, the EGR throttle apertures 2740 are each configured to receive one of the EGR adaptor fasteners 2728. In some embodiments, at least one of the EGR throttle apertures 2740 is threaded and is configured to threadably engage one of the EGR adaptor fasteners 2728. The EGR throttle body 158 also includes one or more EGR throttle slots 2742 (e.g., channels, etc.). As is explained in more detail herein, the EGR throttle slots 2742 are each configured to receive one of the EGR adaptor fasteners 2728.

The venturi 168 also includes one or more venturi apertures (e.g., bore, etc.). As is explained in more detail herein, the venturi apertures are each configured to receive one of the EGR adaptor fasteners 2728. In some embodiments, at least one of the venturi apertures is threaded and is configured to threadably engage one of the EGR adaptor fasteners 2728.

Figure 42:
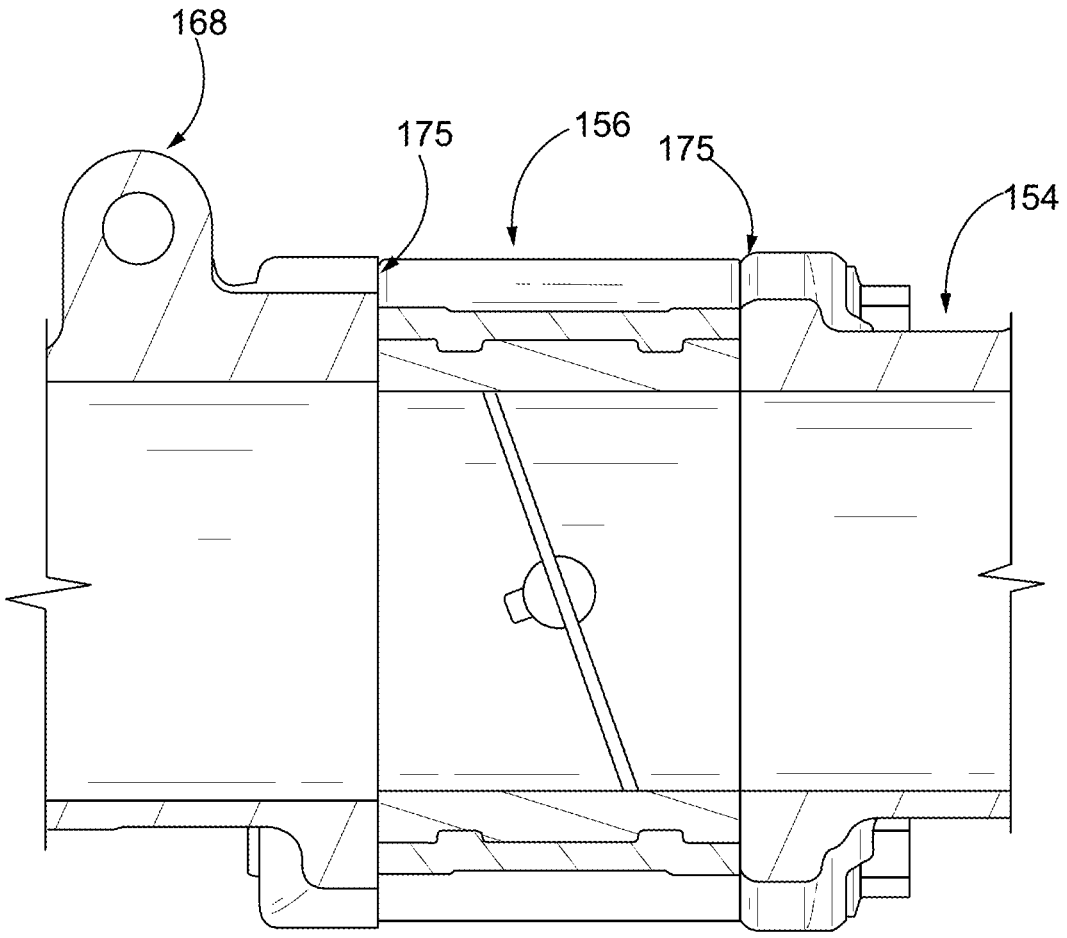
FIG. 42 is a cross-sectional view of a portion of the intake manifold assembly shown in FIG. 27.

FIG. 42 shows the EGR adaptor 154, two of the EGR gaskets 175, the EGR throttle 156, and the venturi 168 coupled together. This is accomplished by inserting at least one of the EGR adaptor fasteners 2728 through one of the EGR adaptor outlet flange apertures 2726, one of the EGR gasket apertures 2732 of one of the EGR gaskets 175, one of the EGR throttle apertures 2740, one of the EGR gasket apertures 2732 of another of the EGR gaskets 175, and one of the venturi apertures of the venturi 168. Additionally, one of the EGR adaptor fasteners 2728 is inserted through one of the EGR adaptor outlet flange slots 2730, one of the EGR gasket slots 2734 of one of the EGR gaskets 175, one of the EGR throttle slots 2742, one of the EGR gasket slots 2734 of another of the EGR gaskets 175, and one of the venturi apertures of the venturi 168.

The EGR adaptor outlet flange slots 2730, the EGR gasket slots 2734, and the EGR throttle slots 2742 facilitate removal of the EGR throttle 156 while the venturi 168 remains coupled to the EGR adaptor 154. Specifically, the EGR adaptor fasteners 2728 that are inserted through the one of the EGR adaptor outlet flange apertures 2726, one of the EGR gasket apertures 2732 of one of the EGR gaskets 175, one of the EGR throttle apertures 2740, one of the EGR gasket apertures 2732 of another of the EGR gaskets 175, and one of the venturi apertures of the venturi 168 are removed (e.g., unthreaded from the venturi apertures and withdrawn through the EGR gasket apertures 2732, the EGR throttle aperture 2740, and the EGR adaptor outlet flange aperture 2726, and the EGR adaptor fasteners 2728 that are inserted through one of the EGR adaptor outlet flange slots 2730, one of the EGR gasket slots 2734 of one of the EGR gaskets 175, one of the EGR throttle slots 2742, one of the EGR gasket slots 2734 of another of the EGR gaskets 175, and one of the venturi apertures of the venturi 168 are loosened. In this way, servicing or removal of the EGR throttle 156 is expedited because additional time required to realign and couple the EGR adaptor 154 and the venturi 168 is minimized.

III. Construction of Example Embodiments

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the terms "approximately," "generally," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The term "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

It is important to note that the construction and arrangement of the various systems shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the disclosure, the scope being defined by the claims that follow. When the language "a portion" is used, the item can include a portion and/or the entire item unless specifically stated to the contrary.

Also, the term "or" is used, in the context of a list of elements, in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, the use of ranges of values (e.g., W1 to W2, etc.) herein are inclusive of their maximum values and minimum values (e.g., W1 to W2 includes W1 and includes W2, etc.), unless otherwise indicated. Furthermore, a range of values (e.g., W1 to W2, etc.) does not necessarily require the inclusion of intermediate values within the range of values (e.g., W1 to W2 can include only W1 and W2, etc.), unless otherwise indicated.

What is claimed is:

1. An intake manifold assembly comprising:

an exhaust gas recirculation system including a venturi with a venturi body, the venturi body comprising:

an upstream cylindrical portion in exhaust gas receiving communication with a cylinder of an internal combustion engine system and configured to receive the exhaust gas from the cylinder, a convergent portion contiguous with the upstream cylindrical portion and in exhaust gas receiving communication with the upstream cylindrical portion, a downstream cylindrical portion contiguous with the convergent portion, separated from the upstream cylindrical portion by the convergent portion, and in exhaust gas receiving communication with the convergent portion, and a divergent portion contiguous with the downstream cylindrical portion, separated from the convergent portion by the downstream cylindrical portion, and in exhaust gas receiving communication with the downstream cylindrical portion; and an intake manifold with an intake manifold body, the intake manifold body comprising:

an air inlet body configured to receive air, an exhaust gas inlet body in exhaust gas receiving communication with the divergent portion, and an outlet body in air receiving communication with the air inlet body and exhaust gas receiving communication with the exhaust gas inlet body;

an upstream isolator, wherein the venturi body further comprises an upstream intake flange having an upstream intake flange aperture, the upstream isolator inserted within the upstream intake flange aperture; and an upstream fastener, wherein:

the venturi body further comprises an upstream boss having an upstream boss aperture;

the intake manifold body further comprises an upstream venturi flange having an upstream venturi flange aperture;

the upstream isolator comprises an upstream isolator aperture;

the upstream fastener is received within the upstream isolator aperture, the upstream venturi flange aperture, and the upstream boss aperture;

the upstream fastener threadably engages the upstream boss aperture;

the upstream fastener does not threadably engage the upstream venturi flange aperture; and the upstream fastener does not threadably engage the upstream isolator aperture.

2. The intake manifold assembly of claim 1, further comprising a downstream isolator, wherein the venturi body further comprises a downstream intake flange having a downstream intake flange aperture; and wherein the downstream isolator is inserted within the downstream intake flange aperture.

3. The intake manifold assembly of claim 2, further comprising a downstream fastener, and wherein:

the downstream isolator comprises a downstream isolator aperture;

the venturi body further comprises a downstream boss having a downstream boss aperture;

the intake manifold body further comprises a downstream venturi flange having a downstream venturi flange aperture;

the downstream fastener is received within the downstream isolator aperture, the downstream venturi flange aperture, and the downstream boss aperture;

the downstream fastener threadably engages the downstream boss aperture;

the downstream fastener does not threadably engage the downstream venturi flange aperture; and the downstream fastener does not threadably engage the downstream isolator aperture.

4. The intake manifold assembly of claim 1, wherein the outlet body comprises:

an outlet body inner surface;

an outlet body opening disposed on the outlet body inner surface, the outlet body opening contiguous with the exhaust gas inlet body; and an outlet body wall extending from the outlet body inner surface and around at least a portion of the outlet body opening.

5. The intake manifold assembly of claim 4, wherein the outlet body wall extends around an entirety of the outlet body opening.

6. The intake manifold assembly of claim 5, wherein:

the outlet body opening is elliptical; and the outlet body wall is elliptical.

7. The intake manifold assembly of claim 4, wherein the outlet body wall is defined by a height from the outlet body inner surface, the height being in a range of 25 millimeters to 50 millimeters, inclusive.

8. The intake manifold assembly of claim 1, wherein:

the upstream cylindrical portion has an upstream cylindrical portion diameter; and the downstream cylindrical portion has a downstream cylindrical portion diameter that is less than the upstream cylindrical portion diameter.

9. The intake manifold assembly of claim 8, wherein:

the upstream cylindrical portion has an upstream cylindrical portion length; and the downstream cylindrical portion has a downstream cylindrical portion length that is less than the upstream cylindrical portion length.

10. The intake manifold assembly of claim 9, wherein:

the upstream cylindrical portion diameter is substantially constant along the upstream cylindrical portion length; and the downstream cylindrical portion diameter is substantially constant along the downstream cylindrical portion length.

11. The intake manifold assembly of claim 9, wherein the divergent portion has a divergent portion diameter and a divergent portion length, the divergent portion diameter increasing at greater distances along the divergent portion length from the downstream cylindrical portion.

12. The intake manifold assembly of claim 11, wherein the divergent portion length is less than the upstream cylindrical portion length and greater than the downstream cylindrical portion length.

13. The intake manifold assembly of claim 1, wherein:

the exhaust gas recirculation system further comprises an exhaust gas recirculation valve;

the upstream cylindrical portion is in exhaust gas receiving communication with the exhaust gas recirculation valve; and the exhaust gas recirculation valve is operable to control flow of the exhaust gas through the venturi body.

14. The intake manifold assembly of claim 13, further comprising:

a radial seal member disposed between the divergent portion and the exhaust gas inlet body; and an exhaust gas recirculation gasket;

wherein the exhaust gas recirculation valve has an exhaust gas recirculation valve body, and wherein the exhaust gas recirculation gasket is disposed between the exhaust gas recirculation valve body and the upstream cylindrical portion.

15. An internal combustion engine system comprising:

a cylinder head having a hot side and a cold side;

an exhaust manifold configured to receive exhaust gas from the cylinder head, the exhaust manifold coupled to the hot side; and an intake manifold assembly comprising:

an intake manifold configured to receive air, receive the exhaust gas, and provide a mixture of the air and the exhaust gas to the cylinder head, the intake manifold coupled to the cold side, the intake manifold comprising an upstream venturi flange having an upstream venturi flange aperture, an upstream isolator, and an exhaust gas recirculation system comprising a venturi with a venturi body configured to receive the exhaust gas from the exhaust manifold and to provide the exhaust gas to the intake manifold, the venturi body comprising an upstream intake flange having an upstream intake flange aperture;

wherein the upstream isolator is inserted within the upstream intake flange aperture, and wherein:

the upstream isolator comprises an upstream isolator aperture;

the intake manifold assembly further comprises an upstream fastener;

the venturi body further comprises an upstream boss having an upstream boss aperture;

the upstream fastener is received within the upstream isolator aperture, the upstream venturi flange aperture, and the upstream boss aperture;

the exhaust gas recirculation system further comprises an exhaust gas recirculation valve having an exhaust gas recirculation valve body that is coupled to the venturi body; and the exhaust gas recirculation valve is operable to control flow of the exhaust gas through the venturi body.

* * * * *